US012808199B2

(12) United States Patent
Hatzinikolas

(10) Patent No.: US 12,808,199 B2
(45) Date of Patent: Nov. 24, 2026

(54) SUPPORT BRACKET ASSEMBLY AND METHOD

(71) Applicant: FERO CORPORATION, Edmonton (CA)

(72) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 87 days.

(21) Appl. No.: 18/603,446

(22) Filed: Mar. 13, 2024

(65) Prior Publication Data

US 2024/0218669 A1 Jul. 4, 2024

Related U.S. Application Data

(60) Division of application No. 17/516,327, filed on Nov. 1, 2021, now Pat. No. 11,952,783, which is a continuation of application No. 16/841,611, filed on Apr. 6, 2020, now Pat. No. 11,162,265.

(51) Int. Cl.

| | |
|---|---|
| ***E04C 3/00*** | (2006.01) |
| ***E04F 13/08*** | (2006.01) |
| ***E04F 13/14*** | (2006.01) |

(52) U.S. Cl.

CPC ..... *E04F 13/0805* (2013.01); *E04F 13/0862* (2013.01); *E04F 13/14* (2013.01)

(58) Field of Classification Search

CPC ... E04F 13/0805; E04F 13/14; E04F 13/0821; E04F 13/142

See application file for complete search history.

(56) References Cited

U.S. PATENT DOCUMENTS

| | | | | |
|---|---|---|---|---|
| 779,268 | A * | 1/1905 | Elliott | E04B 2/30 52/428 |
| 1,455,712 | A | 5/1923 | Collins | |
| 1,697,003 | A | 1/1929 | Fink | |

(Continued)

FOREIGN PATENT DOCUMENTS

| | | |
|---|---|---|
| CA | 3252687 A | 2/2006 |
| DE | 3128246 A1 | 2/1983 |

(Continued)

OTHER PUBLICATIONS

International Search Report & Written Opinion dated Mar. 12, 2020 for PCT/CA2019/051727.

*Primary Examiner* — Basil S Katcheves

(74) *Attorney, Agent, or Firm* — Smart & Biggar LP

(57) ABSTRACT

A support assembly for mounting masonry veneer to supporting wall structure has a first shelf angle, a second shelf angle, and a first shelf angle mounting bracket. Each shelf angle mounting bracket has an upwardly extending back that mounts to the supporting wall structure, and a web extending forwardly away from the wall structure. The web has at least a first shelf angle mounting seats formed in a lower region thereof that hangs downwardly of a vertical load shear transfer connection. A brace is mounted to the bracket. The brace underhangs the cantilevered supporting structure, and provides a moment reaction. The brace has a non-intrusive interface with the supporting structure. That interface may be in compression and the brace may act as a strut. The brace may be thermally isolated from the bracket. The brace may fit within the space envelope of a stud wall.

12 Claims, 9 Drawing Sheets

(56) References Cited

Figure 1A:
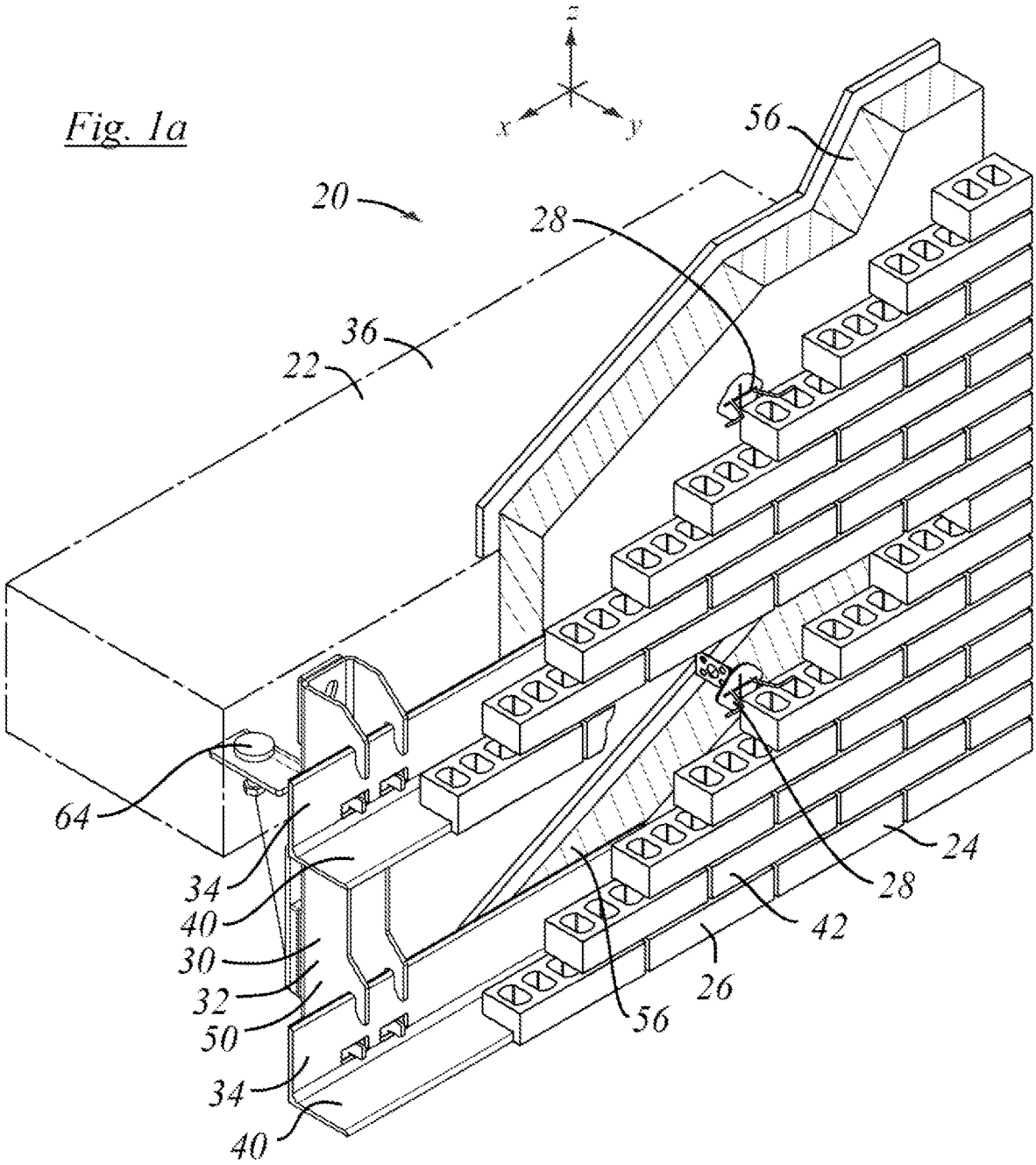

U.S. PATENT DOCUMENTS 1,729,935 A 10/1929 Froehlich
1,764,134 A 6/1930 Young et al.
1,951,730 A * 3/1934 Johnson ..... F16C 35/02 384/626
2,363,156 A * 11/1944 Sinner ..... E04H 13/003 52/378
3,050,160 A 8/1962 Chesser et al.
3,234,702 A 2/1966 Zibell
3,341,909 A 9/1967 Havener
3,414,224 A 12/1968 Watford et al.
3,450,427 A * 6/1969 Artur ..... E04F 13/0855 52/378
3,666,303 A 5/1972 Huls
3,680,271 A 8/1972 Satchell
3,730,466 A 5/1973 Swanquist
3,942,292 A * 3/1976 Robinson ..... E04B 1/7046 52/204.2
4,013,253 A 3/1977 Perrault et al.
4,094,415 A 6/1978 Larson
4,390,103 A 6/1983 Husband
4,422,610 A 12/1983 Hunt
4,429,850 A 2/1984 Weber et al.
4,447,961 A 5/1984 Valat
4,515,494 A 5/1985 Robilliard et al.
4,553,366 A 11/1985 Guerin
4,558,548 A * 12/1985 Hieger ..... E04F 13/0826 52/235
4,805,367 A 2/1989 Smolik
4,827,684 A 5/1989 Allan
4,869,043 A * 9/1989 Hatzinikolas ..... E04B 1/4185 52/712
4,908,952 A * 3/1990 Joos ..... E04F 13/14 33/526
D311,858 S 11/1990 Richmond
5,018,323 A 5/1991 Clausen
5,035,099 A 7/1991 Lapish
5,063,715 A 11/1991 Goodman
5,082,388 A 1/1992 Lauterbach
5,265,396 A * 11/1993 Amimoto ..... E04F 13/0855 52/235
5,313,752 A 5/1994 Hatzinikolas
5,392,581 A 2/1995 Hatzinikolas et al.
5,405,116 A 4/1995 Shepherd et al.
5,456,435 A 10/1995 Sweeney
5,588,537 A 12/1996 Hagopian
5,619,734 A 4/1997 Chen
5,619,834 A * 4/1997 Chen ..... E04F 13/0855 52/235
5,673,529 A 10/1997 Treister et al.
5,794,902 A 8/1998 Henry et al.
5,816,008 A 10/1998 Hohmann
6,041,561 A 3/2000 LeBlang
6,098,942 A 8/2000 Heath
6,128,883 A * 10/2000 Hatzinikolas ..... E04B 1/4178 52/378
6,159,575 A * 12/2000 Rathsack ..... F16B 43/009 428/167
6,161,709 A 12/2000 Kluge et al.
6,226,947 B1 5/2001 Bado
6,298,620 B1 10/2001 Hatzinikolas
6,584,741 B1 7/2003 Hatzinikolas
6,817,688 B2 11/2004 O'Halloran
6,973,756 B2 12/2005 Hatzinikolas
7,367,165 B2 5/2008 Hatzinikolas
7,392,911 B2 7/2008 Stitchick et al.
7,415,803 B2 * 8/2008 Bronner ..... E04B 1/4178 52/378
7,469,659 B2 12/2008 de Jonge et al.
7,614,590 B2 11/2009 Boville
7,654,058 B2 2/2010 Hatzinikolas
7,765,771 B2 8/2010 Serpico et al.
7,908,804 B2 * 3/2011 Vieira ..... E04C 3/02 52/204.2
8,051,621 B2 11/2011 Hatzinikolas
8,250,827 B2 8/2012 Lin et al.
8,333,048 B2 12/2012 Talpe
8,490,340 B2 * 7/2013 Hatzinikolas ..... E04B 1/94 52/99
8,490,341 B2 * 7/2013 Hatzinikolas ..... E04B 1/94 52/99
8,516,763 B2 * 8/2013 Hohmann, Jr. ..... E04B 1/4178 52/383
8,555,595 B2 10/2013 Hatzinikolas
8,621,802 B2 * 1/2014 Spyrou ..... E04B 1/388 52/489.1
8,667,763 B2 3/2014 Hatzinikolas
8,893,452 B2 * 11/2014 Hatzinikolas ..... E04F 13/142 52/712
8,955,263 B2 2/2015 Hatzinikolas
9,010,050 B2 4/2015 Hatzinikolas
9,010,062 B2 4/2015 Hill
9,027,301 B2 5/2015 Guinn
9,200,439 B1 12/2015 Egri
9,316,004 B1 * 4/2016 Hatzinikolas ..... F16M 13/02
9,447,585 B2 9/2016 Hatzinikolas
10,294,676 B2 5/2019 Hatzinikolas
10,323,419 B2 6/2019 Hatzinikolas
10,480,197 B2 11/2019 Hohmann
11,162,265 B2 11/2021 Hatzinikolas
2002/0148935 A1 * 10/2002 Chambers ..... E04B 2/82 248/231.9
2006/0156682 A1 7/2006 McAndrew et al.
2006/0272251 A1 12/2006 Hatzinikolas
2009/0071092 A1 * 3/2009 Vieira ..... E04C 3/02 52/703
2010/0287864 A1 11/2010 Hatzinikolas
2011/0061337 A1 3/2011 O'Shea
2011/0107711 A1 5/2011 Foley
2013/0118107 A1 5/2013 Maday
2014/0174014 A1 6/2014 Hatzinikolas
2014/0190110 A1 7/2014 Hatzinikolas
2015/0059259 A1 3/2015 Hatzinikolas
2016/0153198 A1 * 6/2016 Hatzinikolas ..... E04F 13/22 52/702
2016/0244967 A1 * 8/2016 Zhou ..... E04F 13/14
2016/0305113 A1 * 10/2016 Hatzinikolas ..... E04F 13/0801
2019/0249443 A1 8/2019 Moghimi
2020/0157803 A1 * 5/2020 Weber ..... E04B 2/18
2020/0340225 A1 * 10/2020 Spofford ..... A47B 91/02
2020/0378132 A1 12/2020 Hatzinikolas
2021/0310252 A1 10/2021 Hatzinikolas

FOREIGN PATENT DOCUMENTS

EP 1375777 A1 1/2004
GB 2417039 A1 2/2006

* cited by examiner z
x
y
20
118
122
50
104
120
108
116
40
46
75
72

SUPPORT BRACKET ASSEMBLY AND METHOD

This application claims benefit as a divisional of U.S. patent application Ser. No. 17/516,327 filed Nov. 1, 2021, itself a continuation of U.S. patent application Ser. No. 16/841,611 filed Apr. 6, 2020, the specification and drawings thereof being incorporated in their entirety herein by reference.

FIELD OF INVENTION

This specification relates to structural materials for use in the construction of buildings, and, in one particular context, to support structure external veneer components.

BACKGROUND OF THE INVENTION

In former times, brick stone, or other masonry walls were load bearing structures. In contemporary building structures bricks, or other masonry elements, or other visible finished surface elements, are rarely load-bearing and tend more often to be employed as surface cladding on the exterior face of load-bearing structure. When mounting face brick or stone veneer on the face of a wall structure, it is common to support the first row of bricks, or stone, or veneer on a steel support. In the art, the steel support for the masonry veneer may be termed a "shelf angle". The "shelf angle" extends outward from the wall structure, and runs along, or has a major dimension extending in, a direction that is generally horizontal and cross-wise to the wall. The steel support is mounted to the load-bearing wall, or load-bearing framing, before brick-laying commences. The steel support may be welded to a steel anchoring system embedded in the wall. Alternatively, the steel support may be carried in spaced-apart brackets that have themselves been mounted to the load bearing wall structure.

In an era of energy conservation, the shelf angle is carried on brackets that stand outwardly from the load bearing structure, outside the vapor barrier and external sheathing (if any), so that the back of the shelf angle is spaced away from the structure. This is intended to leave spacing for insulation to be placed between the external sheathing of the building walls and the back of the shelf angle. Furthermore, in view of the tendency for condensation to form on the outer face of the insulation, it is also now customary to leave an air gap between the insulation and the back of the masonry veneer.

Shelf angles are used in a variety of contexts in building masonry veneer walls. Where the masonry veneer wall is tall, it is required to use shelf angles as a break in the wall if the wall is over a given height, such as 30 feet. In other circumstances, the shelf angle is used as the datum at the bottom edge of the commencement of the veneer cladding. In still other circumstances a shelf angle is used to establish the upper sill of a window or a door.

For one reason or another, a masonry veneer installation may employ a shelf angle at one height, but may also employ a second shelf angle at another, fairly close height. For example a long shelf angle may be used at or near the level of a floor slab, while another shelf angle may be used to establish a sill height for a door or window below that floor. Alternatively, one style of masonry veneer may be used at and above one shelf angle, while another style may be used above the other, as in circumstances where a change in brickwork pattern is intended by the architect to achieve a desired visual or textural effect. In such an instance, there is a need for shelf angles to be mounted in relatively close proximity.

In earlier construction, when the masonry was load-bearing or when the masonry was placed directly against the sheathing of the building envelope, either there was access to both sides of the masonry as it was laid, or the backing structure abutted the masonry. In either case, the mason could remove excess mortar at the time of brick laying and jointing, or the backing structure formed a barrier to mortar migration. By contrast, in a contemporary masonry veneer wall, the air gap does not provide room to remove excess mortar with a trowel or provide space to use a jointer afterward. There is a tendency for excess mortar in the inside to fall between the masonry veneer and the insulation. This is not generally helpful, since the mortar that falls downward may block weep holes in the brick or may otherwise obstruct drainage passageways. Further, when a shell angle is used, moisture trapped by fallen mortar on the shelf angle may tend to cause rusting. If the rust leaks, it may then yield staining visible on the outside of the wall.

Furthermore, there is a variety of non-standard circumstances in which more specialized installation arrangements may be required. For example, there may be circumstances where a mounting is required directly to a load bearing member such as a beam, where it is desired for the vertical load to be carried into a flange. It may be desired for the vertical load to be spread or divided into the flange at locations distant from a penetration through the flange. In some circumstances the attachment may be to a vertical web of the structural member. In some circumstances the rearward side of the structural web may not be easily accessible, as when the structural member is a closed-periphery hollow structural section. In some cases it may be desirable locally to reinforce the location of the structural load transfer interface. In other instances, the mounting connection may be to a concrete member, be it a beam or a floor slab, or some other structure. Concrete structures may include reinforcement bars, i.e., re-bar. Concrete structures may also be thinner in one direction than another, such that an anchor placement may be better in one orientation or location than another. Anchor embedments in concrete in which either the connection is in tension, or the connection is being twisted, or both, may tend not to be optimal, and this non-optimality may be heightened where the embedment is in relatively close proximity to rebar.

SUMMARY OF INVENTION

In an aspect of the invention there is a masonry veneer support assembly for mounting masonry veneer to supporting wall structure. The support assembly has a shelf angle, and a shelf angle mounting bracket; and a brace. The shelf angle mounting bracket has a back and a pair of legs. The legs define respective first and second webs standing forwardly away from the back. The first and second webs have respective first and second shelf angle seats defined in corresponding forward margins thereof distant from the back. The shelf angle being engageable with the first and second shelf angle seats. The back of the shelf angle has a mounting fitment at which mechanically to secure the mounting bracket to the supporting wall structure. The brace is mounted to the mounting bracket and extends rearwardly thereof. The brace defines a load path eccentric to the mounting fitment. The brace has a footing that engages non-invasively with the supporting wall structure.

In a feature of that aspect, the footing is a pad. In another feature, the footing is a non-tensile load transmitting member. In still another feature, the brace is adjustable. In a further feature, the pad is adjustable. In another feature, the assembly includes a concrete anchor, and the fitment is secured to the concrete anchor. In still another feature, the assembly includes a concrete anchor. The concrete anchor is embedded in a predominantly upright face of a concrete slab of the supporting wall structure. The fitment is secured to the concrete anchor by a mechanical fastener at an interface at which vertical shear loads are carried between the mounting bracket and the supporting wall structure. In another feature, the brace is mounted in compression. In still another feature, the footing of the brace is a pad that mounts against an under-face of the concrete slab. In a yet further feature, the shelf angle seat has a an upper extremity. The pad has a contact height. The contact height is located at a level that is higher than the upper extremity of the shelf angle seat.

In another aspect of the invention there is a masonry veneer support assembly for mounting masonry veneer to supporting wall structure. The support assembly has a shelf angle, a shelf angle mounting bracket, and a brace. The shelf angle mounting bracket has a back that mounts to the supporting wall structure, and a web extending forwardly away from the wall structure. The back of the shelf angle mounting fitting has a fitting formed therein by which to secure the mounting bracket to the supporting wall structure. The web has a first shelf angle mounting seat formed therein. The shelf angle mounting seat extends forwardly of the back. The brace extends between the mounting bracket and the supporting wall structure. The brace defines a load path between the mounting bracket and the supporting wall structure, the load path acting through a moment arm located eccentrically relative to the mounting fitting of the back of the mounting bracket.

In a further aspect, there is a masonry veneer support assembly for mounting masonry veneer to supporting wall structure. It has a shelf angle, and a shelf angle mounting. The shelf angle mounting has a shelf angle seat defining a force transfer interface at which loads from the shelf angle are transmitted to the shelf angle mounting. The shelf angle mounting having a first force transfer output interface and a second force transfer output interface. The first force transfer output interface includes a hardware fitment mounted to prevent escape of the mounting from the wall structure. The second force transfer output interface includes at least a passive footing. The passive footing is non-co-planar with the hardware fitment.

BRIEF DESCRIPTION OF THE ILLUSTRATIONS

Figure 1B:
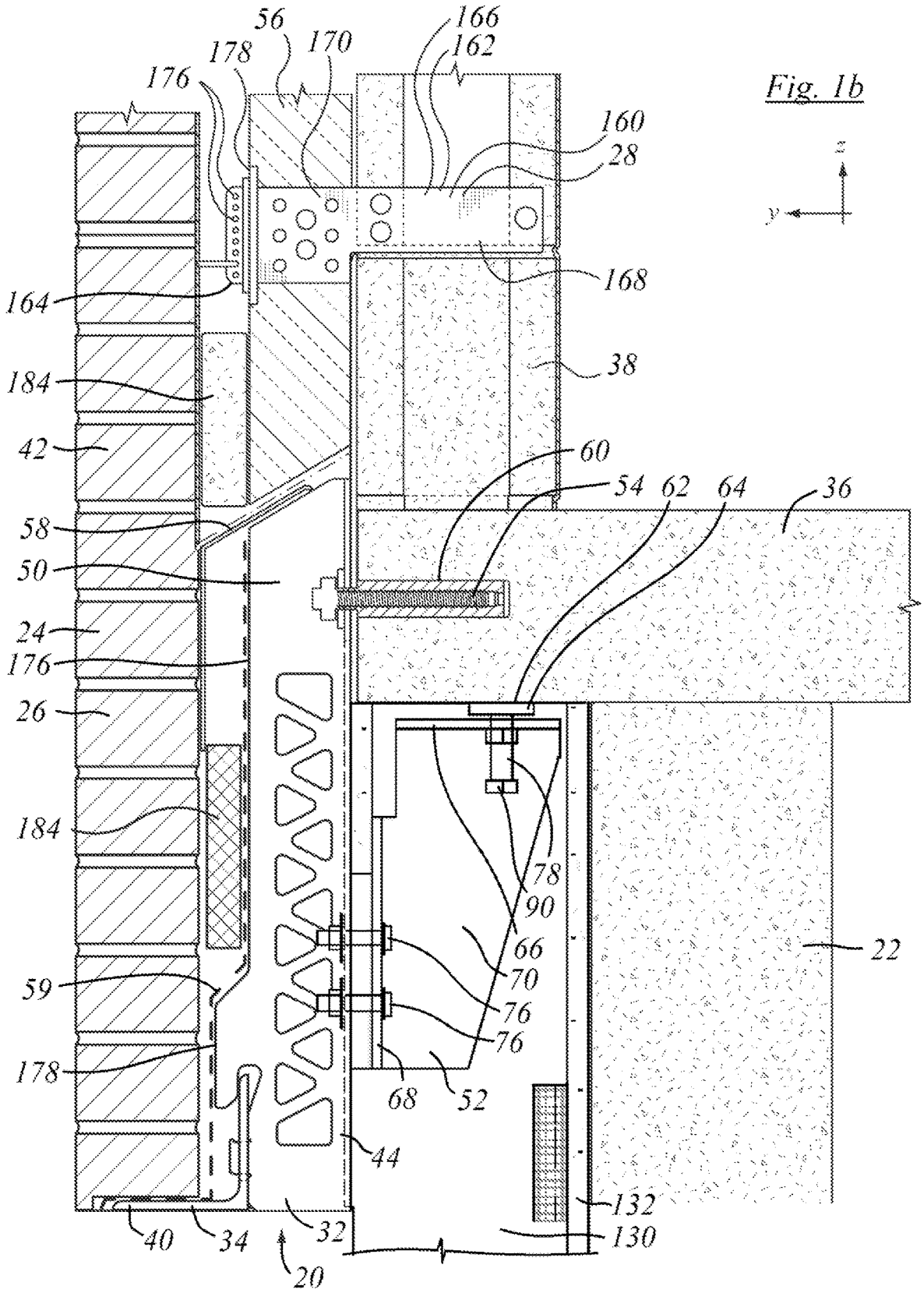

The foregoing aspects and features of the invention may be explained and understood with the aid of the accompanying illustrations, in which:

FIG. 1*a* is a perspective view of a scab section of a wall assembly showing the relative positions of components;

FIG. 1*b* is a side view in section of a general arrangement of an assembly of wall elements similar to those of FIG. 1*a;*

Figures 2A, 2B:
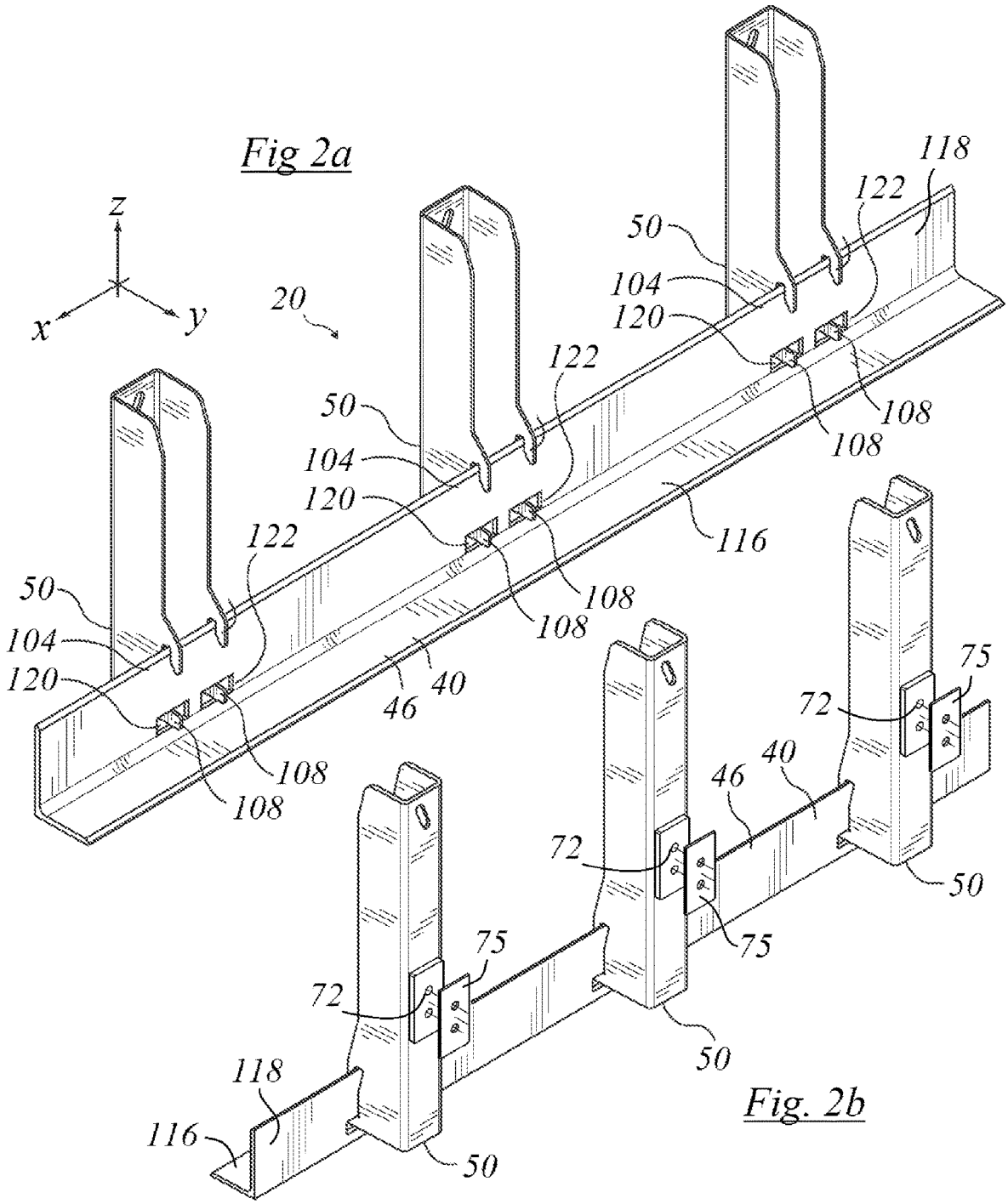

FIG. 2*a* is an isometric view of a shelf angle and associated mounting brackets for the assembly of FIG. 1*a* or FIG. 1*b;*

FIG. 2*b* is a reverse isometric view of the shelf angle and mounting brackets of FIG. 2*a;*

Figure 2C:
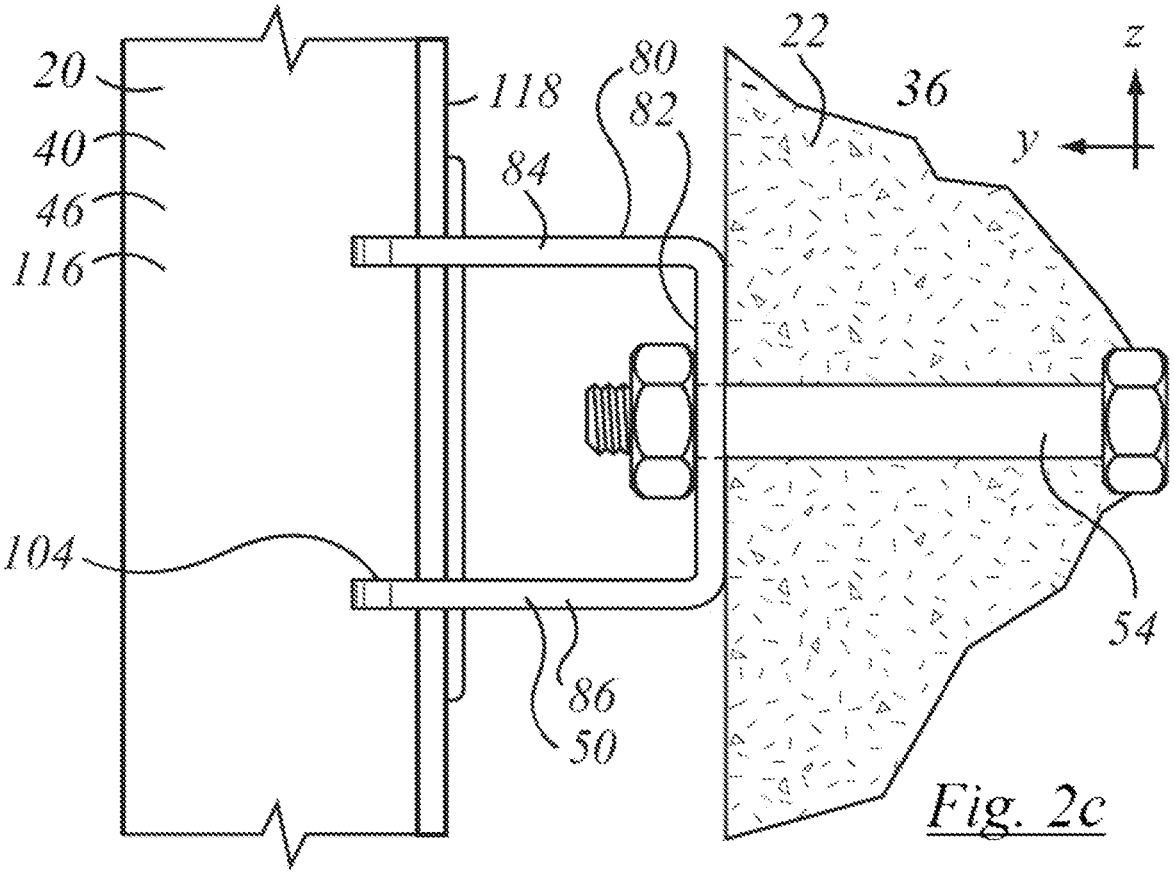

FIG. 2*c* is a top view of one of the mounting brackets of FIG. 2*a;*

Figure 2D:
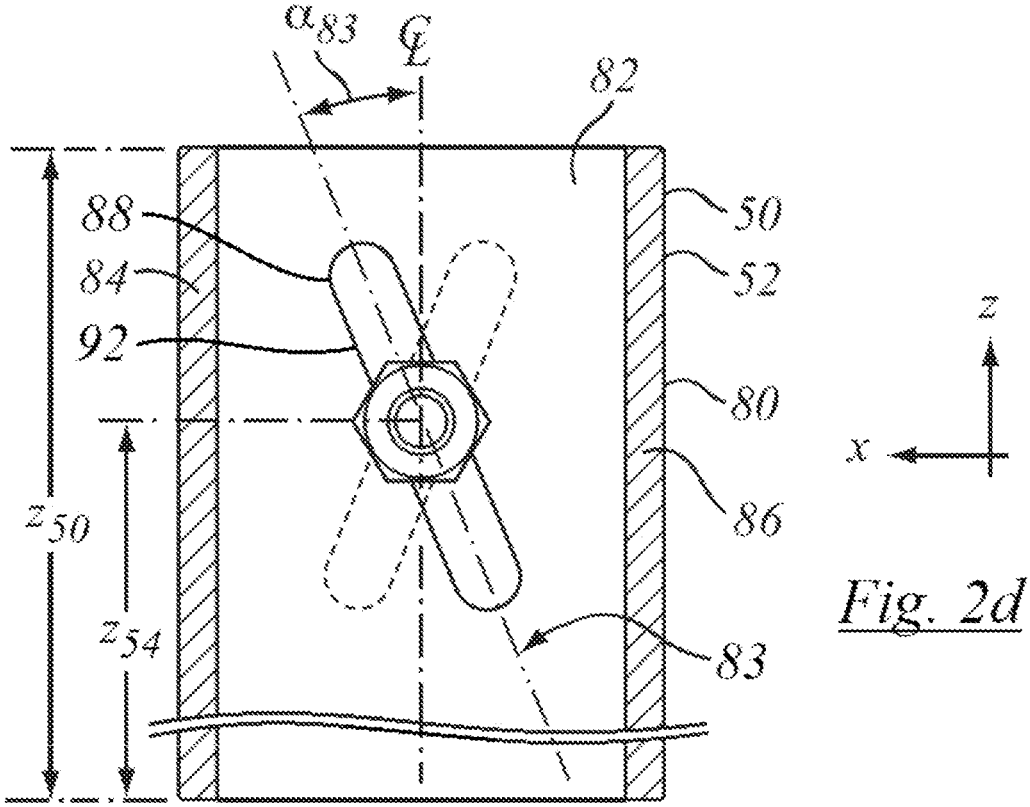

FIG. 2*d* is a foreshortened front view of the mounting bracket of FIG. 2*c;*

Figure 2E:
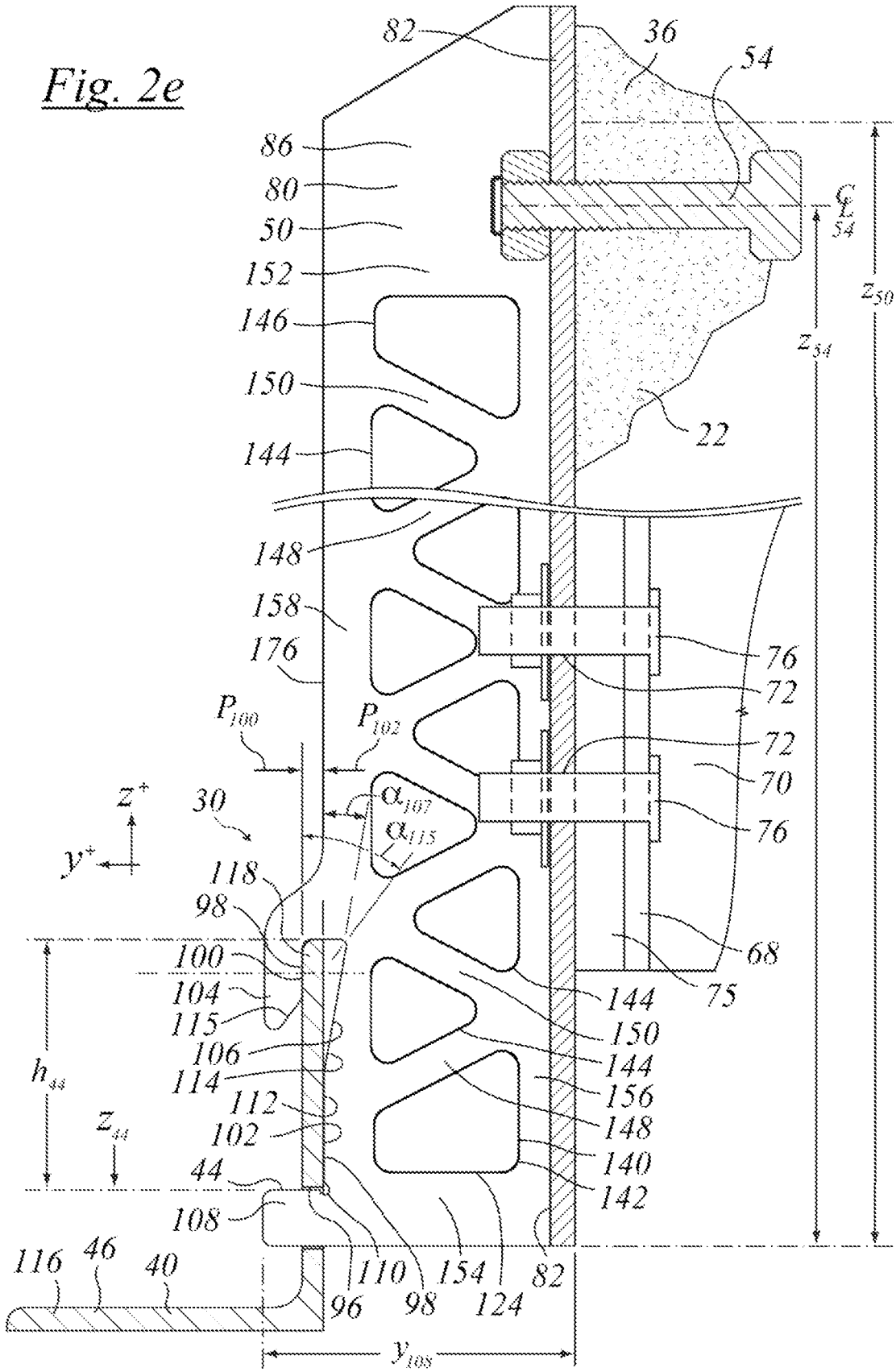
Figure 3A:
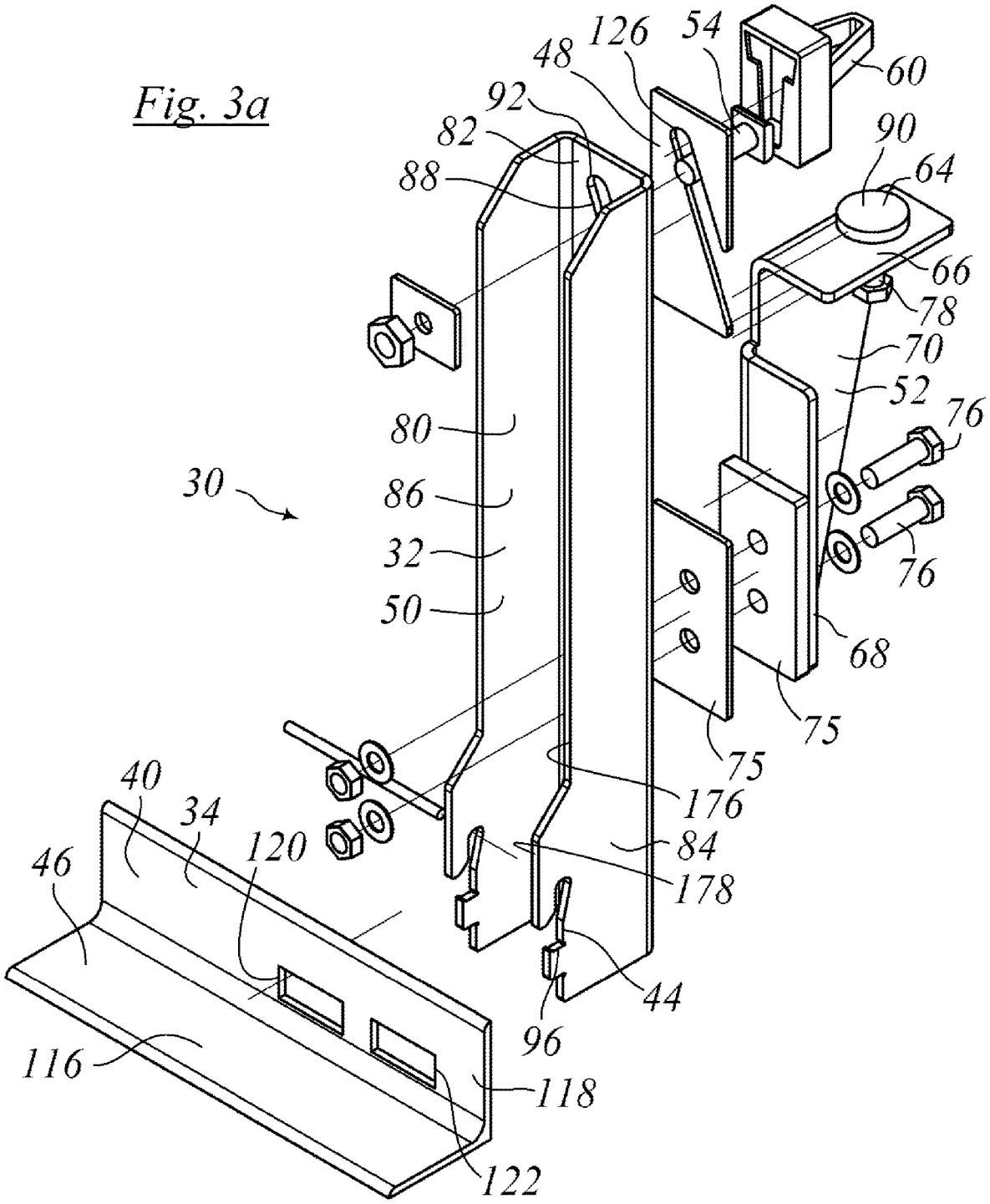

FIG. 2*e* is an enlarged and foreshortened view of the support bracket of FIG. 1*b* as installed;

FIG. 3*a* is an exploded view of a shelf angle and mounting bracket assembly such as may be used in the assemblies of FIGS. 1*a* and 1*b;*

Figure 3B:
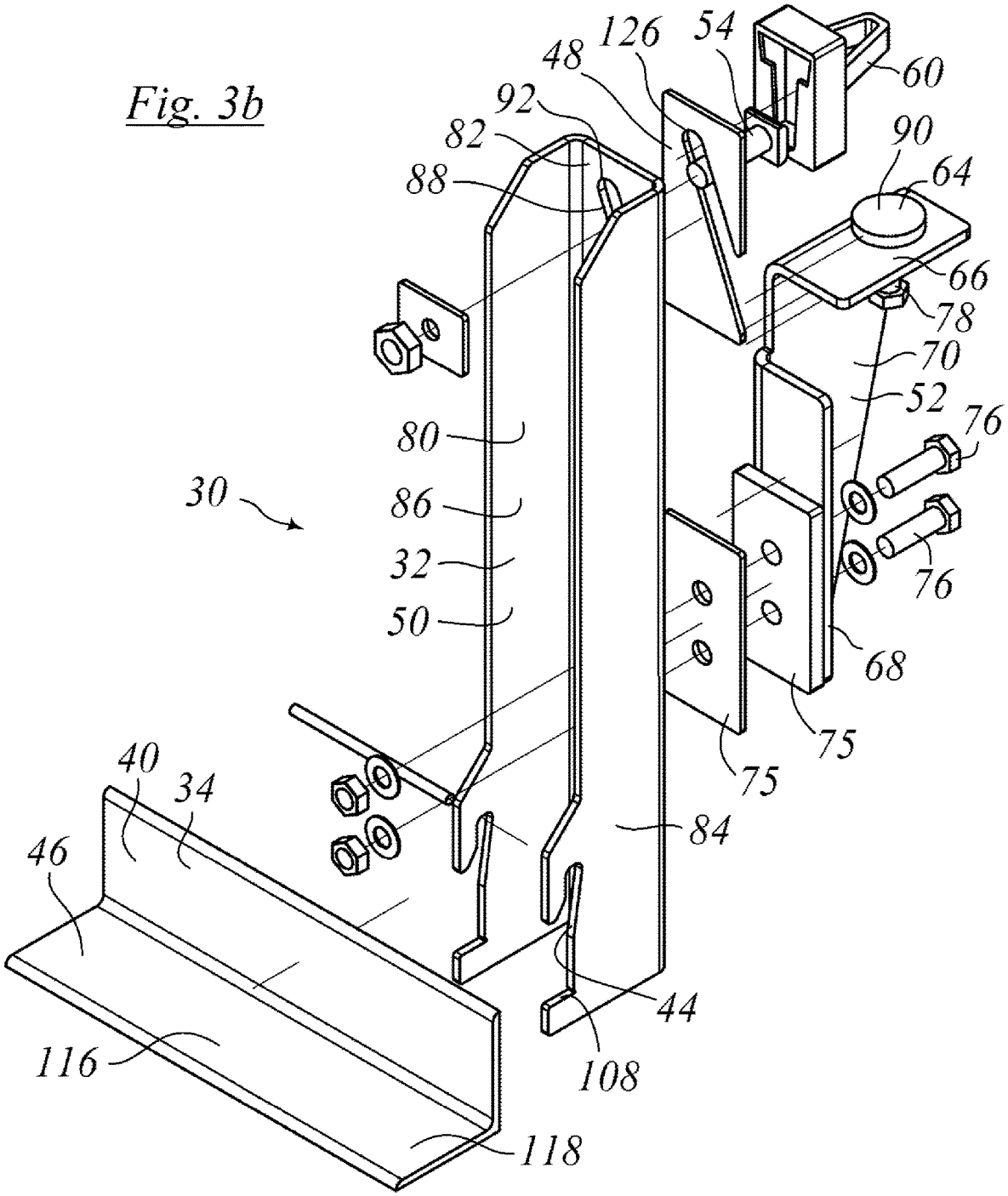

FIG. 3*b* is an exploded view of an alternate mounting assembly to that of FIG. 3*a;*

Figure 4B:
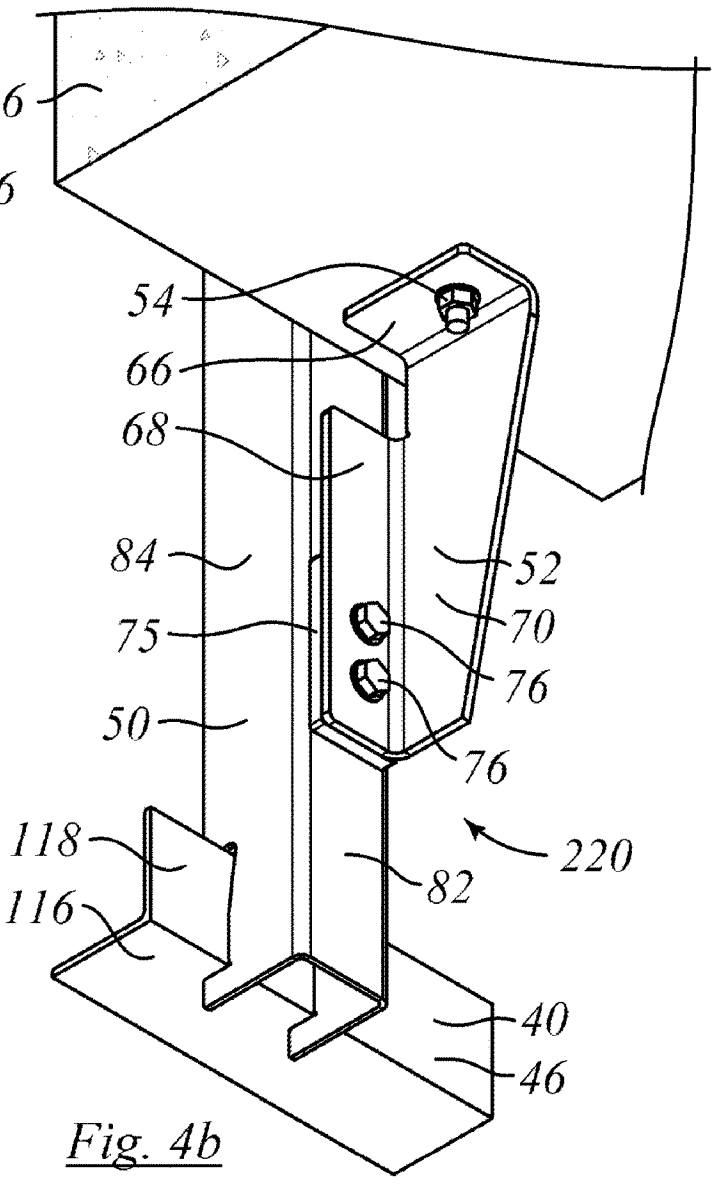
Figure 4A:
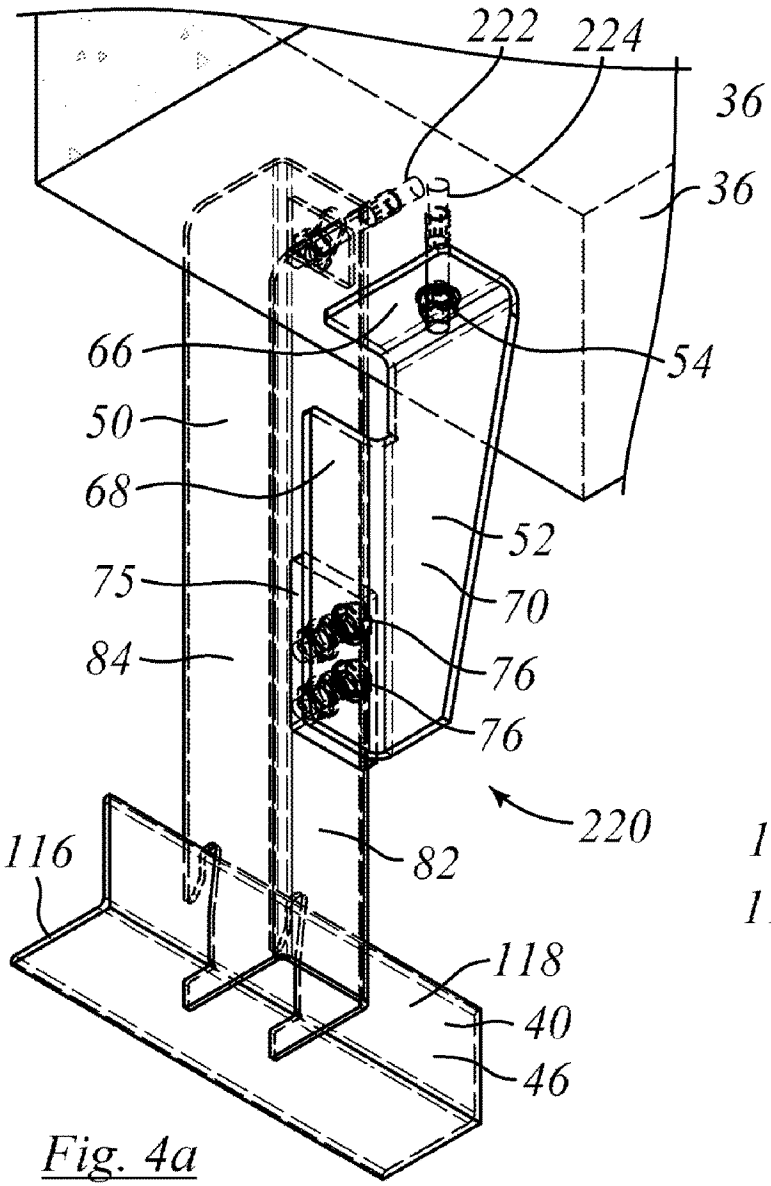
Figure 5B:
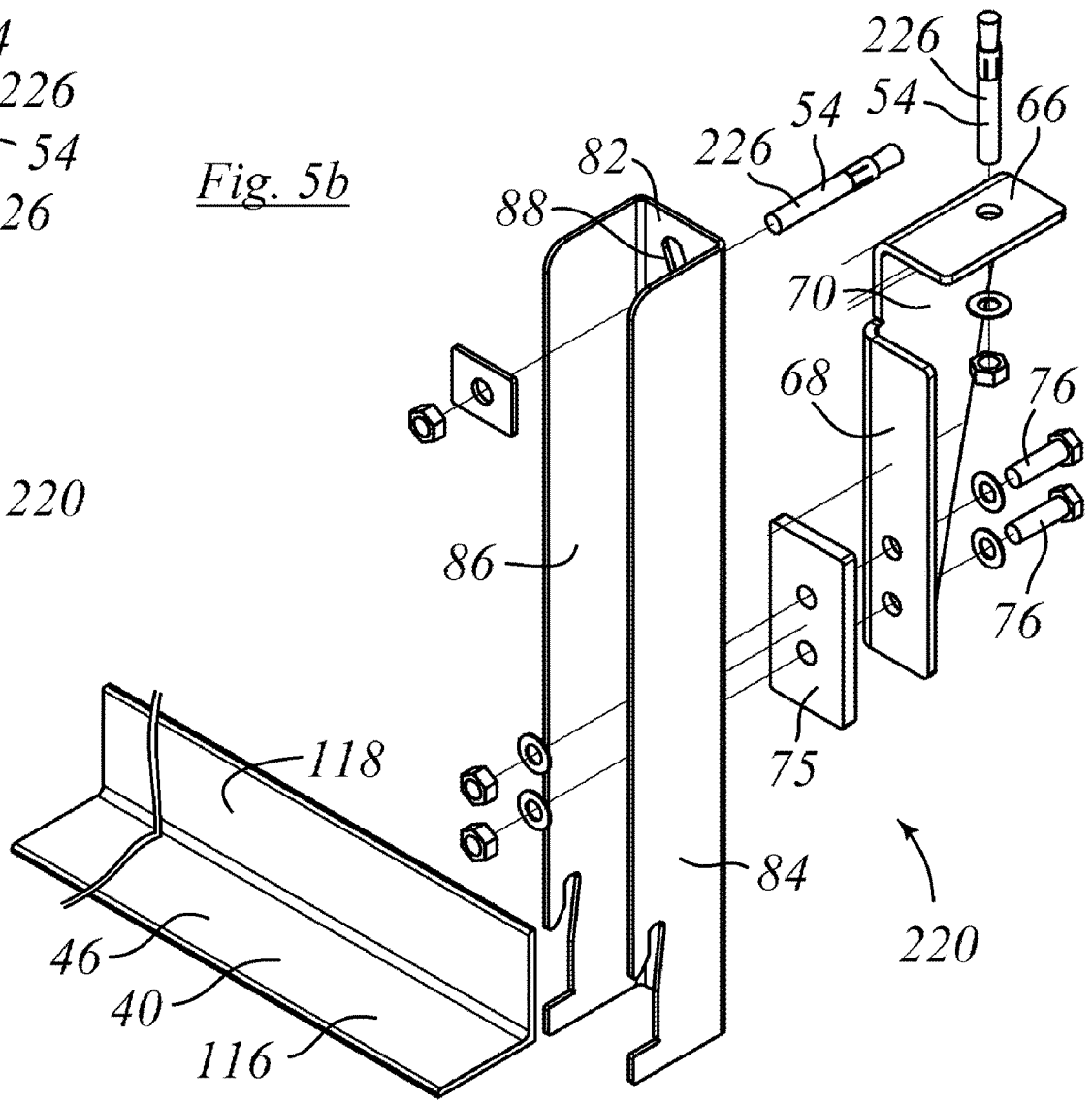
Figure 5A:
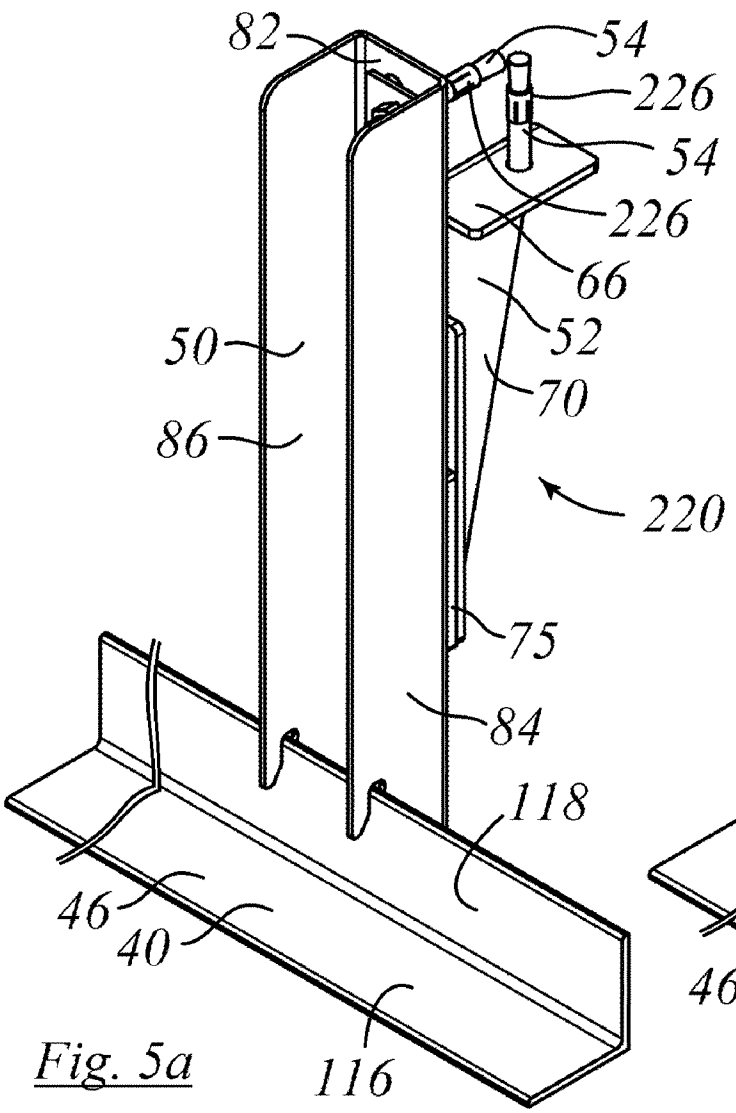

FIG. 4*a* shows an isometric view from below, behind, and to the left of an alternate assembly of wall elements to that of FIGS. 1*a* and 1*b*, with items shown in phantom;

FIG. 4*b* shows the same assembly as FIG. 4*a*, omitting phantom lines;

FIG. 5*a* is an isometric view of the assembly of FIG. 4*a* from in front, to the left and above; and FIG. 5*b* shows the assembly of FIG. 5*a* in exploded form.

DETAILED DESCRIPTION

The description that follows, and the embodiments described, are provided by way of illustration of an example, or examples, of embodiments of the principles of the invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The terminology used in this specification is thought to be consistent with the customary and ordinary meanings of those terms as they would be understood by a person of ordinary skill in the art in North America. The Applicant expressly excludes all interpretations that are inconsistent with this specification. In this description the term "shelf angle" is a term of art in the field of masonry installation. It refers to an angle iron having a horizontal leg and a vertical leg. The horizontal leg defines a flat surface upon which masonry veneer is installed. The masonry veneer is typically in the form of bricks. The vertical leg of the shelf angle mates with mounting brackets that carry the vertical load of the veneer into the supporting wall structure. The shelf angle extends to span a number of mounting brackets. Unless stated otherwise, shelf angles and mounting herein are fabricated from mild steel. The steel may have anti-corrosion or anti-heat transfer coatings, or both.

In the various embodiments, the exterior of the mounting bracket may have an external coating. That coating may be a low thermal conductivity coating. It may be referred to as a thermal insulation coating, or a thermal resistance coating, or a thermal barrier, or thermal barrier coating, or thermal insulation layer. In this discussion, "low" thermal conductivity can be arbitrarily assessed as being less than 1 W/m-K. In general, thermal conductors such as metals and metal alloys have a thermal conductivity greater than 1 W/m-K. By contrast, materials commonly understood to be thermal insulators, such as wood materials, plastic resins, insulating ceramics, and so on, tend to have a thermal conductivity less than 1 W/m-K In some embodiments, the coating may have a thermal conductivity that is less than 1/50 of the thermal conductivity of the material from which the body of the mounting bracket is made, e.g., mild steel. In some instances the thermal conductivity of the coating may be less than 0.1 W/m-K.

In this description, reference is made to load-bearing structure, and load-bearing wall structure. The description pertains to mounting bracket assemblies that support external facing veneer components, such as face brick, spaced away from the supporting structure.

The mounting brackets are anchored to load-bearing structure. Whether that load bearing structure is a structural wall, or a concrete floor slab carried by framework, by a poured wall, by a block wall, or other load bearing members, in the context of this description whether it is a wall, a floor, or a ceiling, within the meaning of this specification it is a load-bearing wall structure to which the veneer supporting members may be mounted.

For the purposes of this description it may be helpful to consider a Cartesian co-ordinate frame of reference. The vertical, or up-and-down, direction may be designated as the z-axis, or z-direction. The direction perpendicular to the plane of the page may be considered as the longitudinal direction or x-direction, or x-axis, and may be taken as being the cross-wise direction of the wall. The left-to-right direction in the plane of the page, i.e., perpendicular to the wall, may be considered the sideways, or y-direction, or y-axis.

FIGS. 1*a* and 1*b* illustrate a general arrangement of a wall assembly, indicated generally as 20. Wall assembly 20 generally includes a load-bearing structure 22, which may include various framing members, as well as insulation panels and sheathing (be it plywood or oriented strand board (OSB)), and vapour barriers. Wall assembly 20 also includes an external facing veneer assembly made up of masonry veneer facing elements identified as 24. Those elements may be face brisk or facing stone, for example. External facing veneer assembly 24 may have a first or forward surface facing outward from the wall assembly 20 to provide a cladding of the structure. The cladding may be a form of masonry veneer, and is identified as 26. Examples of masonry veneer are face brick and stone facing. The externally visible facing elements are mated to, or linked to, or stabilized by, load bearing structure 22. The linking, or positioning, of the facing elements relative to load-bearing structure 22 is achieved by the use of interface elements such as supports, or support assemblies, 30, and tying members 28. Support assemblies 30 and tying members 28 may be taken as being made of mild steel unless otherwise noted. The externally facing masonry veneer facing elements 24 are connected to load-bearing structure 22 by vertical load transfer assembly 30. Generically, in whichever embodiment is chosen, assembly 30 may be understood to include a first member 32 such as a mounting fitting or mounting bracket 50; and a second member 34, such as a shelf angle 40. In this assembly there is an auxiliary support, which may also be termed a support member, an extension, a reinforcement, a wing, a brace, a bracket, an arm, a strut, or a wedge 52. All of these terms of nomenclature may be used in respect of item 52, although for convenience it will be referred to most often herein as wedge 52. As shown in the assembly of FIG. 1*a*, vertical load transfer assembly 30 may also include an additional second member 34, typically mounted in the same vertical and horizontal plane, and spaced away therefrom in the x-direction. Second member 34, i.e., shelf angle 40, then spans two or more of them.

In some such assemblies, as in the assembly of FIG. 1*a*, there is both a lower shelf angle 40 and an upper shelf angle 40 as well. First member 32 may be a receiving member with which both of the second members 34 co-operate. Support assemblies 30 and tying members 28 may be taken as being made of mild steel unless otherwise noted. Combinations of load bearing frame or wall assemblies, such as structure 22, facing elements 24, support assemblies 30 and tying members 28 may be assembled as indicated in FIG. 1*a* or 1*b*.

Note that the terminology of assembly 20 is used in a generic sense that is applicable to the assembly of FIG. 1*a* and to also to the assembly of FIG. 1*b*, although those assemblies they are not exactly the same. The terminology is intended to apply to assemblies having the foregoing features in common, in whatever form. Load-bearing structure 22 may have several different forms. First, it may include a foundation, which may be a poured concrete foundation. There may be a floor structure, such as a poured concrete floor slab 36. Floor slab 36 is shown transparently in FIG. 1*a* to permit the relative location and orientation of wedge 52 to be seen. There may also be a stud wall below floor slab 36. For the purposes of this description, floor slab 36 may be understood to be made of poured or cast concrete with steel rod reinforcing bars, i.e., rebar, embedded in the concrete, typically in the lower half thereof which may tend sometimes to be subject to loading in tension. The rebar may be understood to include rods that run parallel to the end face of the slab, i.e., predominantly in the x-direction.

Floor slab 36 may carry a wall structure 38 which may have the form of laid blocks, or which may in other embodiments include a framed structure, such as may be a wood or steel framed structure. Visible facing elements 24 may include brickwork 42, or stonework, be it rough stone or finished stone, or other cladding. There are many forms of visible facing elements, which may be referred to generally as masonry veneer. The anchor system described may be used for supporting masonry veneer, thin granite veneer, large stone panels or pre-cast concrete in place of the bricks. In the examples of FIG. 1*a* and 1*b*, facing elements 24 are shown as brickwork 42 that includes bricks laid in successive courses.

Second members 34 provide a base or bench or shelf for the external facing elements 24 in the form of shelf angles 40. Shelf angles 40 may have the form of angle irons 46, that run along the wall structure in the horizontal direction and provide a bed upon which the bricks or other masonry of the external facing veneer 26 find support, hence angle irons 46 may be termed a brick support. Although non-square shelf angles are known, square angles are readily available from rolling mills in standard sizes.

Each second member 34 is mounted to first member 32 on installation. Each second member 34 may span two or more first members 32, as shown in the arrangement of FIGS. 2*a* and 2*b*. As noted, mounting brackets 50 may receive a single shelf angle 40, as in FIG. 1*b* or, where provided with suitable accommodations, they may accept more than one shelf angle 40, as in the upper-and-lower double shelf angle arrangement of FIG. 1*a*.

In FIG. 1*a*, a first shelf angle 40 is to be located near to the level of the securement to load-bearing structure 22 and a second shelf angle 40 is to be located at some distance below the level of the securement to load-bearing structure 22. A second shelf angle 40 may support external masonry veneer 26 above a window or door opening or installation. A structural feature such as a window or door may result in a gap in the external facing veneer members. Thus, the veneer members positioned immediately above the gap (e.g., above the window or door) need to be supported by an additional shelf angle 40.

First member 32 is itself fixedly mounted to the load bearing wall structure 22. The vertical load of the facing, e.g., brickwork 42, is carried by the bench or "shelf" of second member 34, and passed into such number of first members 32 as may support second member 34. First member 32 may have a depth (in the y-direction) that may correspond to, or may be greater than, the thickness of insulation panels 56 such as may be mounted to the front (or outside) face of structural load-bearing wall assembly structure 22. As shown in FIGS. 1*a*, and 1*b*, the shelf angle seat, or seats, 44 of the first members 32 may be positioned outward of the insulation panels when the first members 32 are secured to the load-bearing wall assembly structure 22. Inasmuch as each leg 84, 86 of first member 32 may pass through the wall insulation panels 56, each mounting bracket leg 84, 86 may also have an array of apertures 140 that may reduce the section for heat transfer in the y-direction.

Where a masonry veneer wall is carried on support members such as those of first member 32 and second member 34, the mounting brackets 50 may be anchored to an edge of a concrete slab 36 at an anchor fitting 60. A component of the anchor load in concrete slab 36 may be a tension load. There is also a moment couple. The tension load on anchor fitting 60 is a function of the length of the mounting bracket bearing on the edge of slab 36 to establish a moment arm in the vertical direction over which to resist the moment couple. Larger distance between the point of tension on anchor fitting 60 and the point of compression on the bearing surface tends to be helpful, as it reduces the rotational twisting load on the anchor. Concrete slab floors are typically 8" to 10" in thickness and the anchor is often located at the middle or center of the slab edge. This may yield a short moment arm, which may in turn yield tension and torsional loads that are undesirably high for the anchor. It may be impractical to increase slab thickness for the purpose of increasing the moment arm. In that light, the apparatus herein provides a structural member that, as noted above, may be identified as an arm, or a brace, or a reinforcement, or a strut, or a wedge 52. Wedge 52 extends from the lower end of first member 32 to the underside of concrete slab 36, rearwardly distant from the leading edge in which the anchor fitting 60 is embedded. This increases the moment arm and moves the point of compression from the slab edge to the underside of slab 36, i.e., the distance between the interface in tension and the interface in compression is increased.

The use of a second anchor fitting 60 in this circumstance would imply installation of the second anchor fitting 60 as an embedded fitting introduced into the underside of slab 36. Embedded anchors in concrete may be problematic, possibly more so in the underside of a slab in which rebar is present. Further, where mounting bracket 50 already has one fixed anchor fitting 60 into the slab edge, a second fixed anchor location in the underside of the slab may tend to increase installation difficulty as the two anchors may then require a high degree of alignment accuracy relative to each other. Further, use of two embedded anchors as two fixed anchorage points may tend to reduce adjustability.

Use of a support, in this case in the form of wedge 52, is different in that it is a simple support type rather than a pinned or fixed anchor, meaning that it does not need to anchor into the underside of slab 36, thereby providing an increased moment arm without the problematic issues that may otherwise arise from an intrusive installation such as an embedded anchor. That is, a footing, or pad in compression, is able to transmit a compressive load with a non-intrusive mounting interface in which it abuts, but does not penetrate, the load transfer interface surface.

Adjustment is obtained by providing a footing 90 in which the bearing surface of the wedge-shaped support has a threaded rod 78 and locknuts to permit adjustability to ensure pad 64 makes contact with the underside of slab 36 in a satisfactory manner, and with the leg defined by back 82 of mounting bracket 50 suitably vertical.

There is often a stud wall 130 behind the mounting bracket installation. Stud walls in these circumstances may often be nominally 6 inches thick. That is, the true dimensions of a 2×6 stud are roughly 1½"×5½" or 38 mm×140 mm. When reference is made to a 2×6 or to a 6" stud wall, it is understood in North America, and in this specification, that it is referring to the nominal "2×6". The internal wall material, such as gypsum wall board 132 is then mounted on the inside of the studs, beyond which lies the interior of a room of the building. The support, or wedge 52 may then be sized to fit within the thickness of the stud wall, and accordingly to be concealed within the common 6" space of that stud wall. The space so defined may be taken as lying in this space between the vertical plane of the outside face of wall board 132 and the vertical plane of the inside face of back 82 (where back 82 is used without a shim that would increase the dimension by the shim thickness). As described, wedge 52 has a dimension in the y-direction in FIG. 1*b* that is less than or equal to the nominal 2×6 depth contained between those two vertical planes. Lying within that space envelope, wedge 52 lies rearwardly (or inwardly) of the plane of back 82 (or, alternately expressed, the plane of the outward end face of slab 36). Wedge 52 also lies downwardly of the horizontal plane of the bottom face of slab 52. This may be alternately expressed as lying beneath the overhang, or under the cantilever, of concrete slab 36.

An alternative to the use of a support such as wedge 52 is to make mounting brackets 50 stronger. However, the wall thickness dimension in the y-direction between the supporting wall structure and the masonry veneer is typically fixed, and may be relatively small in any event. Another approach is to use more support brackets, or to use thicker material in the support brackets. This may be problematic in terms of weight, cost, and manufacturing difficulty. The use of a support member, such as a diagonal or wedge-shaped bracket, or wedge 52, may permit it to be lighter and easier to install separately from the mounting bracket 50. Wedge 52 may also tend to increase the distance a shelf angle 40 can be dropped given the relatively high stiffness it may offer, and as shown in FIG. 1*b*, within the space envelope of stud wall 130.

Looking at wedge 52 in greater detail, considering the example of FIGS. 1*a*-1*b* there is a masonry veneer support mounting assembly, i.e., vertical load transfer assembly 30 that mounts to an overhanging, or cantilevered structural member or structural assembly, namely the end face of concrete floor slab 36 of load bearing structure 22 of structural wall assembly 20. In this instance, mounting bracket 50 has the form of a long-legged channel, such as shown or described herein in various alternatives. Although only a single-ended, depending shelf-angle seat 44 is shown in FIG. 1*b*, mounting bracket 50 could be, or could have, a double-ended arrangement, also shown in FIG. 1*a*. There is a shelf angle 40, and masonry veneer 26. Assembly 30 has not only a first structural anchor, or vertical shear load transfer interface, as at anchor fitting 60, but also a second load transfer interface 62 as at the meeting engagement where pad 64 of support wedge 52 encounters the underside of slab 36.

That is, there is a reinforcement, or arm, or extension, or brace, or gusset, or auxiliary bracket, or strut, or secondary bracket, or support, symbolized by wedge 52, however it may be called. Wedge 52 has a body with a web 70, a first flange 66, and a second flange 68. As installed, web 70 stands in a vertical plane between the lower back of mounting bracket 50 and slab 36. First flange 66 extends square to web 70 along a vertical edge thereof in x-z planar abutment against back 82 of mounting bracket 50. Second flange 68 extends square to web 70 along the upper, horizontal edge thereof in an x-y plane in facing opposition to floor slab 36. First flange 66 has a mating fitting, or fittings 72 that mates to a lower region of back 82 of mounting bracket 50 at a first mating interface that is downwardly distant from anchor fitting 60. Mating fittings 72 may be connected to back 82 by mechanical fasteners such as bolts or rivets 76. In the example shown there are two such fasteners 76 such that support 52 is prevented from rotating about the y-axis relative to back 82 of bracket 50, i.e., it has no translational or rotational degree of freedom at that connection. In some instances, such as where it would be helpful to reduce heat flow through mounting bracket 52, or where there is a need to take up a dimensional tolerance for a sheet of wall board or sheathing, there may be one or more shims, or plates, or doublers, or spacers 75 to take up that space. Doubler or spacer 75 may be a thermal insulator, or it may have a thermal insulation coating. Or, alternatively, one spacer 75 may be a metal, such as mild steel, e.g., welded to flange 68, and the second spacer 75 may be an insulator.

The body of wedge 52 has a second mating interface fitting, namely pad 64 that meets with the underside of concrete slab 36 to define the second engagement interface 62 of vertical load transfer assembly 30, and particularly of mounting bracket 50, with concrete slab 36 of structural assembly 22. There is a threaded rod, or bolt 78 that mates with second flange 68 and with the back or underside of pad 64. In this case, wedge 52 functions as a diagonal strut or brace to provide a counter-acting clockwise (as seen in the point of view of FIG. 1*b*) rotational moment couple reaction to the counter-clockwise moment of the eccentrically applied vertical load of masonry veneer 26 carried by shelf angle 40. The combination of threaded rod or bolt 78 with pad 64, as mounted and co-operating with second flange 68, defines a mounting fitting 90 that engages the underside of slab 36. Mounting fitting 90 is adjustable. That is, turning the head of bolt 78 either tightens or loosens the engagement of pad 64 against concrete slab 36, and, ultimately, adjusts the angle at which mounting bracket 50 hangs. It is intended that this adjustment will be used to make back 82 hang plumb, i.e., vertical. The offset, or separation of the two mounting points (i.e., of bolt 54 at back 82; and pad 64) defines a moment arm, and the clockwise reaction acting on that arm counter-acts the counter-clockwise overturning eccentric moment on the shelf angle acting on the input arm defined by the horizontal distance between the input interface at toe 108 and the plane of the output interface where back 82 (or its shim 48) abuts slab 36. As noted, mounting assembly 30 is a long-legged assembly that hangs downwardly so that shelf-angle seat 44 is located below (i.e., downwardly proud of) not only floor slab 36, but also below mating fitting 72 (and therefore also mounting fitting 90).

To recap, in each of the embodiments of FIGS. 1*a* and 1*b*, there is a structural support assembly 30 upon which to mount masonry veneer 26. Structural support assembly 30 includes a shelf angle 40; a shelf angle mounting bracket 50; and a brace, i.e., wedge 52. Shelf angle mounting bracket 50 has a back 82 and a leg, or a pair of spaced apart legs, 84, 86 extending forwardly away from back 82. Each leg 84, 86 has a shelf angle seat (or seats) 44 defined therein. Shelf angle 40 locates in its respective shelf angle seat 44 on installation. Back 82 has a rearwardly facing surface that has a first mounting fitting, 88 by which to secure shelf angle mounting bracket 50 to supporting structure 22, through tightening a fastener, or bolt, 54 of anchor fitting 60 embedded in slab 36. Back 82 has a second mounting fitting 72 by which the lower region of back 82 is secured to wedge 52. Wedge 52 in turn has an interface, or mounting fitting, 90 in the form of a footing of pad 64 by which it engages the supporting structure distantly from first fitting 88. The brace or wedge 52 defines a diagonal strut. Supporting structure 22 defines an overhang, or cantilever, being that of slab 36. The first fitting, of bolt 54 through fitting 88 into anchor fitting 60, secures to an end of the overhang. The footing of brace or wedge 52 secures under the overhang. Shelf angle support mounting bracket 50 extends downwardly proud of the overhang, and the shelf angle seat 44 depends from the overhang below the level of the slab. Fitting 90 is a non-invasive footing or interface. That is, it does not require an embedment within the concrete that might otherwise tend to be a location of cracking or failure initiation in the concrete.

In that light, as seen in FIGS. 1*a* and 1*b*, support assembly 30 has a first member 32, which may have the form of a support or mounting bracket 50. Support bracket 50 may have the form of any of the long-legged support brackets of co-pending U.S. patent application Ser. No. 16/426,801, the specification and drawings thereof being incorporated herein by reference, e.g., as seen, at FIGS. 6*a*, 6*b*, 6*c*, 6*d*, 8*a* to 8*k*, 9*a*-9*g*, 16*a*-16*c*, 19*a*-19*d*, and 20*f* thereof. That is, it may be a long-legged mounting bracket with a single, depending shelf angle seat 44, as in FIG. 1*b* hereof; it may be a long-legged mounting bracket with upper and lower shelf angle seats 44, as in FIG. 1*a* hereof. In either case it may have solid side webs as in FIG. 1*a* hereof, or it may have perforated side webs as in FIG. 1*b* hereof. It may be secured to concrete wall structure by an embedded threaded fastener, as in FIG. 1*a* hereof, or it may employ an embedded anchor fitting 60 in which a mating threaded fastener 54 is secured as in FIGS. 2*a* and 2*b* hereof. Support assembly 30 also includes a base or bench or second member 34 that may have the form of a "shelf angle" 40 in the form of an angle iron 46. Angle iron 46 runs along the wall structure in the horizontal direction and provides the bed upon which the lowest course of bricks finds its support, hence angle iron 46 may be termed a brick support. Angle iron 46 may rest with the back of the angle iron seated above a non-load bearing abutment or stop or skirt. Second member 34 may be mounted to first member 32, i.e., mounting bracket 50 which is itself fixedly mounted to load bearing wall structure 22. The vertical load of the facing, e.g., brickwork 42 is carried by the bench or "shelf" of second member 34, and passed into however many mounting brackets 50 as may be.

There may typically be at least first and second such second support members 32 spaced laterally apart. For example, there may be several such supports on, for example, 24" centers, indicated in FIG. 3*a* as spacing Li, which may correspond to the spacing, or an integer multiple of that spacing, e.g., double the spacing, of wall studs in standard framing. Mounting brackets 50 may then carry the shear load from shelf angle 40 into load bearing wall structure 22.

First members 32 are secured to load bearing wall structure 22, by some kind of mechanical anchor, given the generic terminology "anchor fitting" 60. That anchor fitting 60 may, for example, be a mechanical securement in the nature of a threaded mechanical fasteners 54 that has the form of a threaded rod having one end held in the cast concrete. The other end or the threaded rod is secured to mounting bracket 50 with a threaded nut. Alternatively, in the case of securement to a poured concrete wall or floor slab (as shown) the fasteners may be concrete anchor fittings 60 that include an embedded hard point that has a slot or socket into which a mating head of a threaded fastener 54 is inserted. The threaded end passes outwardly into mounting bracket 50 and is secured with a nut as before. In a further alternative, a female socket is embedded in the cast concrete, and a threaded bolt is then used to provide a mechanical fastener securement to the embedded threaded female socket and hence the poured concrete wall. The mechanical fastening need not be releasable, but could be a deformed mechanical securement, such as a rivet or a Huck™ bolt.

First members 32 have a depth (in the y-direction) that may correspond to, or may be greater than, the thickness of insulation panels 56 such as may be mounted to the front (or outside) face of the structural load-bearing wall assembly 22. There may also be a drainage shield, or flashing, 58 such as may encourage moisture to drain outwardly of and away from structural wall assembly 22. A vapor barrier membrane 59 is captured behind insulation panels 56 upwardly of floor slab 36, and may traverse insulation 56 at the level of flashing 58, and may lie overtop of flashing 58 with its lowermost margin draining over angle iron 46, such that any moisture draining over vapor barrier 59 is drained away. That is, a continuous metal flashing 58 is supported on or above shelf angle 40. It may connect to a continuous flexible flashing which extends over the brick supports and that may connect to a vapour barrier membrane on the outer face of the wall. Sheets of rigid insulation 56 are mounted over top of the membrane on the outer face of the wall. The anchor system allows cavity insulation to be continuous behind the brick support. The rigid insulation may be of a thickness that allows an air space between the insulation and the external veneer brick facing mounted on shelf angle 40. The anchor brackets 50 may be made in a variety of sizes each corresponding to a desired thickness of the rigid insulation and air space. In this arrangement, a standard size of brick support shelf angle 40 may be used without regard to the spacing between the brick facing and the face of the wall desired for insulation.

FIGS. 2*a*, 2*b*, 2*c* and 2*d*, show that support bracket 50 may have the form of a channel 80 (as viewed from above, as in FIG. 2*c*) having a first member in the nature of a rear plate or back 82, and a second member in the nature of a web or leg 84. Channel 80 may also have a third member in the nature of a second web or leg 86. In the embodiment shown, legs 84 and 86 stand outwardly of back 82. That is, as installed back 82 may lie in an x-z plane abutting the load bearing structure, be it framing, metal girders, poured concrete wall or poured concrete slab, and so on. Legs 84 and 86 stand outwardly away from that x-y plane. In general, it may be convenient that legs 84 and 86 stand in y-z planes perpendicular to the plane of back 82, standing spaced apart and parallel, but this is not necessarily so. For example, legs 84, 86 could be splayed to form a V or winged shape as opposed to a square-sided U. In the particular embodiment illustrated, legs 84, 86 are a pair of side plates that extend from respective sides of the rear plate, back 82, in a direction away from the wall to form the sides of the U-shaped channel. The side plates are generally rectangular in shape and lie in respective vertical planes.

Back 82 may have a mounting, a seat, or an attachment fitting 88 such as shown in FIG. 2*c* by which mechanical fastener 54 may secure bracket 50 to the load bearing structure. In general, in all of the embodiments herein a shim plate or spacer 48, such as may be substantially similar in size to the width of the back of mounting bracket 50, may be mounted between each mounting bracket 50 and the outer face of the slab 36, as may be suitable, for evenly engaging the concrete surface and for spacing each mounting bracket 50 from the wall. Fitting 88 may be a slot 92 that permits height adjustment of bracket 50. Slot 92 may be oriented at a non-parallel angle or direction that is skewed relative to the vertical axis. Slot 92 may be an elongate aperture in back 82 that extends along an inclined axis 83 angularly offset from vertical. FIG. 2*d* shows a left-hand configuration. The inclined axis may be offset an angle $\alpha_{83}$ that is 22.5 degrees from vertical. In a right hand configuration fastener slot 92 may be offset by an angle $\alpha_{83}$ in the opposite direction. The upright plate of back 82 can thus be fastened to the wall at numerous locations relative to the wall corresponding to different positions of bolt 54 within slot 92 to achieve the appropriate height for the courses of brick or stone veneer, etc., and to yield a horizontal shelf. As installed, fastener 54 may be in tension, and the lowermost edge of back 82 may want to rotate counter-clockwise as seen in FIG. 1*b*. Accordingly, a reaction is provided by support or wedge 52, and the interface at pad 64 will be in compression, i.e., pressed against the load-bearing structure, such that there is a moment reaction and a moment arm. Slot 92 may be located closer to the upper margin of bracket 50 than to the lower margin, such that arm $z_{54}$ between the centerline of bolt 54 and the centroid of lower interface fittings 72, is typically greater than half the height of bracket 50, indicated a $z_{50}$, and larger than the vertical pitch of the seat height $h_{44}$ (FIGS. 2*c* and 2*d*). In the default, the upper datum of $z_{54}$ may be taken as the mid-height location of fitting 88, namely half way up in the middle of slot 92. Slots 92 of successive brackets 50 arrayed along shelf angle 40 may be alternately left handed and right handed. That is, in use, a plurality of the anchor pointes defined by mounting brackets 50 may be spaced horizontally across a wall using a spirit level, a chalk line, and a measuring tape. The anchoring brackets 50 are mounted in an alternating arrangement of left-hand and right-hand configurations. The brackets are mounted along the wall such that each anchoring bracket having a left-hand orientation is beside an anchor bracket having a right-hand orientation. On installation, the vertical shear load may tend to cause the brackets to wedge and lock in position on the fasteners.

The side plates or webs defined by legs 84, 86 receive and carry the brick support defined by angle iron 46. Looking at leg 84 as being representative also of leg 86, and considering the profile shown in FIG. 1*b*, the distal portion of leg 84 (i.e., the portion standing away most distantly from back 82) has a fitting, or accommodation, or seat 44 that is matingly co-operable with second member 34, and that provides a shear load transfer interface in which a vertical gravity load from member 34 is transferred into web or leg 84 (or 86 as may be). The profile of each shelf angle seat 44 in the respective side plates of legs 84, 86 may have the appearance of a recessed channel in the forward or foremost, or distal edge or margin thereof.

Seat 44 includes a vertical reaction interface, indicated at 96, and a moment restraint, indicated at 98. Moment restraint 98 includes an upper reaction member 100 and a lower reaction member 102. Leg 84 (or 86) may have an overhanging member, or finger, 104 that, in use, overreaches, and depends in front of, the uppermost margin of second member 34. The space between finger 104 and the upper leading edge of the body of leg 84 (or 86) more generally defines a receiving slot 106 as, or at, the upper portion of seat 44. Slot 106 extends upward, and has a rearward edge (i.e., at edge or wall 114) at a top end of the recessed, generally channel-shaped profile of seat 44. The inside face of the downward or distal tip of finger 104 may have the form of an abutment, or stop, or restraint that faces wholly, substantially, or predominantly in the −y direction, defining upper reaction member 100.

Vertical reaction interface 96 may be defined as the upper face of the toe, edge, or side of an extending portion or member or dog or toe 108, such as may be or define a protruding extension or protrusion in the y-direction of the lower margin of leg 84. That is, in the embodiment illustrated the recessed channel shape of seat 44 includes a shoulder at a bottom end. That shoulder defines vertical reaction interface 96, and it carries the shelf angle, such that the brick supporting flange extends laterally outward from the wall.

Lower reaction member 102 extends upwardly and away from the root of toe 108, and has the form of a wall or edge that faces wholly, substantially or predominantly in the +y direction. A fatigue detail, or stress relief detail, in the form of a finite radius relief 110 is provided at the root of the intersection of vertical reaction interface 96 and lower reaction member 102. The upper and lower stops (i.e., reaction members 100 and 102) constrain the translational degree of freedom of corresponding upper and lower regions of angle iron 46, and thus define a moment-couple reaction inhibiting motion in the rotational degree of freedom about the x-axis of angle iron 46 in the counter-clockwise direction.

Upwardly of an inflection point 112, wall 114 of seat 44, (being the back or rearward margin of slot 106) is relieved in the −y direction such that seat 44 may include, and slot 106 may be, a slanted slot or accommodation such as to permit entry of the upper leg of angle iron 46 into the accommodation on installation. The angle of inclination $\alpha_{106}$ may be in the range of 10-20 degrees in some embodiments. The lowermost extremity of the inside tip of finger 104 may also be trimmed, or tapered, or chamfered as at 115. The angle or size of the chamfer or relief at 115, designated as $\alpha_{115}$, is steeper, i.e., smaller, than the size of angle $\alpha_{106}$ of the chamfer or relief of wall 114. That is, whereas wall 114 may be angled at 10-20 degrees, from vertical, the relief at 115 may be more than 20 degrees, and may be about 24 or 25 degrees. Lower reaction member 102 may extend in a vertical plane, $P_{102}$. Upper reaction member 100 may extend in a vertical plane $P_{100}$. Planes $P_{102}$ and $P_{100}$ may be parallel and spaced apart, with upper reaction member 100 being more distant from back 82 than is lower reaction member 102. They may be spaced apart by a distance corresponding to the through thickness of the upstanding leg of angle iron 46.

The overall height of seat 44 may be taken from the vertical shear transfer receiving interface of shoulder 96 to the uppermost extremity of slot 106, and is indicated as $h_{44}$ in FIG. 1*b*. In this embodiment, shelf angle 40 is mounted at a height that corresponds generally to the height of the attachment interface of back 82 to the load-bearing support wall structure. This may be expressed several ways. First, it may be expressed in the relative squareness of the mounting bracket when seen in side view, as in FIGS. 2*c* and 2*d*. In this embodiment the most distant extremity of toe 108 is the same distance from back 82 as is the most distant extremity of finger 104.

The brick support defined by angle iron 46 may include a mounting flange which engages anchor bracket 50, and a supporting flange arranged to carry bricks. The mounting flange and the supporting flange may typically be mounted at right angles to form an L-shaped angle iron, typically made of steel. As in FIGS. 1*a* and 1*b*, angle iron 46 has a first or horizontal leg 116 and a second or vertical leg 118. Horizontal leg 116 extends forwardly (in the +y direction) away from vertical leg 118, and hence on installation also forwardly and away from bracket 50. Horizontal leg 116 runs along the wall structure in the x-direction. Typically the running length of the angle iron is much greater than the horizontal leg length. For example, in one embodiment the running length may be 72 inches, while the leg of the angle may be 6 inches or less. In various embodiments the x:y aspect ratio of lengths may be in the range of 4:1 to 16:1. Bracket 50 may be cut to length as may suit. As installed, the length of leg 118 proud of the end of toe 108 in the y-direction may have a length corresponding to the depth in the y-direction of the facing members to be supported. In the case of face brick, that length corresponds to the depth of the face brick. In some embodiments it may be somewhat less than the depth of the face brick to permit the iron to be less noticeably visible, as in FIG. 1*a*, or to be hidden, as in FIG. 3*a*.

In FIG. 1*a*, vertical leg 118 has an accommodation, slot, aperture, socket, or relief, or reliefs 120, 122 spaced upwardly from the junction of members 116 and 118. The lower margin of reliefs 120, 122 may be located at or above the run-off of the rolled radius between members 116 and 118, i.e., in the tangent portion of the vertical leg, rather than in the radius. Reliefs 120, 122 are sized to receive the dogs, or toes 108 of web members or legs 84 or 86. They are over-sized in the x-direction to permit lateral adjustment of bracket 50, as, for example, according to the fastener position along inclined slots 92. For half inch thick legs, the slot may be 2.5 inches wide, giving, potentially, one inch play to either side of center. The height of the slot may be slightly oversize to permit rotating installation of bracket 50. The vertical through thickness of each toe 108 may be 1" or more.

In the engagement of toe or dog 108 in accommodation or relief 120 or 122, as may be, the lowermost margin of the leg need not extend lower than (i.e., downwardly proud of) the bottom of horizontal leg 116, such that no additional vertical clearance allowance is required for toe 108, and toe 108 is concealed behind external veneer facing elements 24 and the bottom edge of the lowest course of bricks may be lower than otherwise. In FIG. 1*a*, 1*b* and 3*a*, the lower received member (i.e., the lower shelf angle 40) is flush with, or extends downwardly proud of, the lowermost portion or extremity of the receiving member (i.e., bracket 50) and, as installed, may tend to conceal it from view. This arrangement may be helpful when mounting veneer members above a door or window installation, as it permits the lower shelf angle to be positioned flush with, or immediately above, the upper level of the window. Expressed differently, in terms of a seating arrangement of structural members, first member 32 may be considered to be the receiving member, and second member 34 may be considered to be the received member. The engagement of the receiving and received members is a mechanical interlocking relationship, biased into securement by gravity acting on the load. That is, while angle iron 46 may be adjustable and engageable while unloaded, the loading of bricks or other surface elements may tend to increase the moment couple on the angle iron, such as may tend to tighten the hold of the moment couple reaction members of the receiving member. This arrangement is in contrast to the arrangement in FIG. 3*b* in which toe 108 is located underneath horizontal leg 116. Further, in the embodiment of FIG. 3*b*, there are no apertures or reliefs 120, 122 in vertical leg 118 of shelf angle 40.

The receiving slot 106 slidably receives an edge portion of the mounting flange of leg 118 therein such that the brick support remains secured to the anchoring bracket 50 when a weight of bricks is stacked on the supporting flange of leg 116. The rearward edge 114 of receiving slot 106 extends upward at a slight rearward incline for accommodating the edge portion of the mounting flange of leg 118 as it is inserted therein. A wedge shaped shim may then be inserted between the distal tip of leg 118 and the rearward edge 114 such as to lock the assembly in tight engagement.

The received member, such as the shelf angle identified as angle iron 46, is itself a receiving member, or accommodation, for the externally visible facing elements, and as the facing elements are received, rearward structure such as bracket 50 is obscured from view. More generally, the received member has a first portion that defines a seat or bench, or accommodation, or support, or platform or undergirding, or shelf, for the externally visible facing members, hence the term "shelf angle". It is a form of sill. The received member also has a second portion that engages the receiving member so the vertical load of the received member is transmitted or carried into the receiving member and thence into the load-bearing supporting structure. The second portion can be thought of as an engagement fitting, or key, or inter-locking feature, or indexing feature, that mates with the receiving member. An L-shaped angle iron may be a convenient form having these properties.

In the embodiment shown in FIG. 1*a*, inasmuch as each leg 84, 86 may pass through the wall insulation panels 56, each leg 84, 86 may also have an array of apertures as at 140, such as may reduce the section for heat transfer in the y-direction. In some embodiments apertures 140 may be non-circular, and may have an oval, oblong, or elliptical form. The form of aperture may have a long axis and a short axis. The long axis may be inclined at an angle to the perpendicular. Alternatively, as shown in FIG. 1*b*, the apertures and strips may have the form of truss elements having the form of triangular openings of alternating hand, separated by diagonal trips of strut of alternating hand. In one embodiment the angle of inclination of the struts may be about 45 degrees. The interstitial strips between adjacent apertures may tend to be correspondingly inclined on a generally diagonal angle.

On installation, the upper portion or region of back 82 of mounting bracket 50 lies in facing abutment against the load bearing wall structure of slab 36, and where the wall is vertical, the back of mounting bracket 50 is correspondingly vertical. The load output interface, namely the connection of mechanical fastener 54, is located at a first height, $z_{54}$. The load input interface of assembly 30, at which the vertical load of the external veneer or cladding is received at leg 84, 86 is identified as a second height, $z_{44}$. The first height is substantially higher than the second height. $z_{44}$ lies at the top shoulder of toe 108, well below the height of the bottom margin of floor slab 36, and at a height that is more than two brick courses (i.e., more than 6") below $z_{54}$. As noted above, side web or leg 84, 86 of channel or bracket 50 is much deeper in the z-direction (see $z_{50}$) than is the depth of the accommodation for the shelf angle, i.e., of second member 34, identified as $h_{44}$.

In FIG. 1*b*, if one defines a load center at the vertical load input interface of the seat, notionally $C_{108}$ and another load center at the connection point, or centroid, of the fastening connection or connections to the load-bearing wall structure, notionally $C_{54}$, the line of action constructed between those centers extends upwardly and toward the load-bearing structure. That line of action is predominantly upwardly oriented, i.e., the rise is greater than the run, as suggested by the ratio of $Rise_{54}/Run_{108}$. The y-direction projection of seat 44 does not fall on the footprint of mounting fitting 88, but rather falls well below it. It is also well below the bottom of concrete floor slab 36. Seat 44 is not in line with mounting fitting 88. On the contrary, the seat is downwardly displaced from the centerline of the mounting fitting at $C_{54}$ by several pitches of the magnitude of the seat height, $h_{44}$. This downward offset of seat 44 (or, from the other perspective, upward offset of fitting 88) is more than one pitch of the seat height, and may be up to 6 or 8 pitches, or may lie in the range of 2 to 8 pitches of the seat height.

In FIG. 1*a*, mounting bracket 50 has first and second seats 44 to support first and second shelf angles 40. Those seats are vertically spaced apart so that one is an upper seat and the other is a lower seat. On assembly, the first or upper shelf angle 40 is supported by the first or upper shelf angle seat 44 while the second or lower shelf angle 40 is supported by the second or lower shelf angle seat 44. As shown in FIG. 1*a*, the upper shelf angle seat 44 supports the second shelf angle 40 at a height proximate to the level of floor slab 36, i.e., within the range of the horizontal projection of the slab, or, e.g., within one seat pitch such as $h_{44}$ therefrom. The upper shelf angle seat may thus support the members of external veneer facing elements 24 positioned at, and above, the level of floor slab 36. The lower shelf angle seat 44 supports the lower shelf angle at a level that is vertically displaced below, i.e., to a level lower than, floor slab 36. Thus, the lower shelf angle is in a position or condition to be able to support members of external veneer facing elements 24 positioned between the lower shelf angle and the level of floor slab 36. The vertical distance between the lower and upper shelf angle seats 44 (and therefore the shelf angles when installed) may be substantially greater than the height or pitch $h_{44}$ of either seat. As a result, the vertical separation between the respective horizontal legs will also be substantially greater than the height of either seat. For example, the vertical separation may be at least twice the height of either first or second seat, and may be as much as five times the height of either first or second seat. Positioning the lower shelf angle seat at a distance vertically lower than floor slab 36 allows mounting bracket 50 to support bricks or other masonry veneer between floor slab 36 and a feature such as a window or door as well as bricks above the level of floor slab 36.

In FIGS. 1*a* and 3*a*, the upper shelf angle seat may be the same as, or may differ from the lower shelf angle seat. The use of the toe-and-accommodation mounting may be most helpful where the shelf angle is intended to conceal the mounting bracket, as above a door or window. By contrast, in the upper mounting, such a consideration might not be pertinent, given that legs 84, 86 extend downward to the lower seat in any event. In that situation, a shelf angle seat of the configuration shown in FIG. 3*b*, with protruding toe 108 being located below the horizontal leg of the shelf angle, would be suitable.

As before, the receiving member (e.g., bracket 50) is rigidly secured to the load bearing wall structure 22. On installation, back 82 of bracket 50 lies abuts the end of floor slab 36. The upper load output interface of the vertical load transfer assembly, namely the connection of mechanical fastener 54 to the load bearing wall, is located at a first height, identified as $z_{54}$. The vertical load transfer assembly shown in FIGS. 1*a* also has upper and lower load input interfaces corresponding to the upper and lower shelf angle seats at which the vertical loads of the external veneer or cladding is received at leg 84, 86. The upper load input interface is identified as a second height; and the lower load input interface is identified as a third height. The third height is below the first and second heights. I.e., the third height lies at a level that is below the height of the bottom margin of the floor slab 36, and at a height that is more than two brick courses (i.e., more than 6") below the second height. Side web or leg 84, 86 of channel or mounting bracket 50 is much deeper in the z-direction than is the depth of the accommodations for shelf angles 40, identified as $h_{44}$.

Fastener 54 for installation in concrete, may have a mushrooming end that expands at the nut us tightened against a washer on the threaded bolt as in FIG. 1*b*. The shim, or spacer 48 has a footprint that corresponds to the width shape of back 82. In the embodiment shown spacer 48 is rectangular, being longer in the vertical direction and shorter in the horizontal direction. It has an open-ended slot 126 formed on the diagonal that matches angled slot 92 formed in back 82. As may be understood, for mounting brackets having fitting adjustment slots of opposite hand, spacer 48 is flipped over to face the other way. Slot 126 matches slot 92 in extent. In effect, spacer 48 is a U-shaped spacer, with the U being slanted on the diagonal rather than vertical. Spacer 48 may be made of mild steel.

Alternatively, it may be made of a lower thermal conductivity material, or mild steel that has been coated in a lower thermal conductivity material or coating, such as to present a thermal resistance to heat flow from the building structure that is greater than mild steel. Spacer 48 may be thin, and may be made of a high density polymer. Alternatively, spacer 48 may be made of steel coated in a polymeric coating, such as the "Aerolon"™ Acrylic, above.

Looking again at the side webs or legs 84, 86, it is seen that they have an array of perforations 140, the perforations or openings or apertures 142, 144, 146 thereof being bounded by a rectangular frame that includes upper cross-member 152, lower cross-member 154, first vertical upright margin 156 along the forward edge thereof; and second vertical upright 158 that is joined to, and co-operates with back 82 to form an angle section. There are also diagonal strut portions 148, 150 that link upright margins 156, 158 as struts, and that separate apertures 142, 144, 146 from each other. As so formed, each leg 84, 86 has the form of a truss. The reduction in metal section arising from the perforations reduces the cross-section of the section available for conductive heat transfer between margins 156 and 158. Furthermore, bracket 50 generally may have a coating to discourage heat transfer. The coating may be a polymeric coating. The polymeric coating may be an acrylic coating. The coating may have, and in the embodiment illustrated does have, an aerogel filler mixed in the resin of the coating. One such product is supplied by Tnemec Inc., 6800 Corporate Drive, Kansas City, MO 64120 USA under the identification "Series 971 Aerolon Acrylic", or simply "Aerolon". The manufacturer suggests the thermal conductivity of the coating may be in the range of 12 mW/m-K. A low thermal conductivity coating may be applied to any of the shelf angle support brackets, or support bracket assemblies shown or described herein.

Returning again to FIGS. 1*a* and 1*b*, in some embodiments, tying members 28 may be located upwardly of support assembly 30. Tying members 28 may have the form of brick tie assembly 160, in which there is an anchor 162 and a brick tie 164. As may be noted, anchor 162 has a body 166 such as may have the form of a stamped steel plate. The distal portion of body 166 may be termed a tail 168. Tail 168 may have a length in the y-direction (i.e., into the wall), such as may be embedded therein. To that end, tail 168 may have perforations such as may permit mortar to flow therethrough. Body 166 may also have a proximal portion 170 of a depth in the y-direction corresponding to the thickness of insulation panel 56. Proximal portion 170 may be perforated to reduce thermal conduction in the y-direction. Proximal portion 170 may have a step, or abutment, or indexing or locating feature, such as a shoulder, by which the correct depth position in the y-direction is obtained relative to the cinder block and the insulation. Body 166 may also have an outermost end portion 174 having an array of tie location apertures, or seats or positions 176. A faceplate 178 seats on the outside face of the insulation, and may be used on installation where the positioning of anchor 162 is set prior to installation of tail 168 in a poured concrete form. Brick tie 164 is then located in one or another of the seat positions 176. When the successive courses of bricks 42 are laid, the outermost ends of brick tie 164 are embedded in the mortar between courses, as in FIG. 1*b*. Tying members as described are used where the air or insulation space between the load bearing structure and the external veneer exceeds one inch, and in all cases where the wall height exceeds 30 ft. Tying members such as those described may be placed on up to 24 inch spacing vertically, and up to 32 inch spacing horizontally.

The example of FIGS. 1*b* also addresses the circumstance in which it is desired for the mortar netting or mortar catching element to be able to be installed to overlap, to sit rearwardly flush with, or to extend rearwardly beyond, the vertical leg of the shelf angle. This may occur where a more compact installation is desired between the insulation and the masonry veneer, or, contrarily, where the shelf angle is presented more distantly from the supporting structure. In this example, the main, or upper, datum portion of the legs or webs of the mounting bracket is a first distance, and, as installed, the vertical lag of the shelf angle lies forwardly of that distance, or, expressed differently, the overhanging retainer, or finger, and the protruding toe, both extend forwardly proud of the general or datum dimension of leg size. In that circumstance, extending the webs of the channel section to the full extent of the finger (or of the toe) would be an unnecessary waste of material, or an obstruction to installation of the mortar netting, or both. So, in FIG. 1*b* the major portion of legs 84, 86 terminates forwardly at a margin 176. Margin 176 lies in a vertical plane. The retainer, identified as finger 104, protrudes or extends forwardly of margin 176 to over-reach the front face of vertical leg 118 of second member 34. As installed, the rearward margin of finger 104 contacts, and engages, the forward face of the upper margin of vertical leg 118, preventing it from rotating counter-clockwise. The outer margin of finger 104 is identified as 178. In this instance, shelf angle 40 has apertures in vertical leg 118, and first member 32 has respective protruding toes 108 that extend through those apertures and receive the vertical shear load of the masonry veneer, as previously described. In this example, margin 178 lies forwardly of, the dominant, or thinner, margin of legs 84, 86, namely margin 176. Further, the distance in the y-direction between margin 176 and margin 178 corresponds to the thickness of mortar net 184, which installs against, and is trapped above, fingers 104, i.e., between margin 176 and the rearward face of masonry veneer 26. In FIG. 1*b*, mounting bracket 50 has mitered upper edges, suitable for installation of a flashing, shown in phantom as 186, indicating that shelf angle 40 is carrying the lowest courses of bricks. First member 32 can have solid continuous side webs as in FIGS. 2*a* and 2*b*, or may have an array of apertures as in FIG. 1*b*, over part or all of the height of side webs 84, 86, and with a short protruding toe 108 as in FIG. 3*a* or a long protruding toe 108 as in FIG. 3*b*.

That is, in the various Figures, the shelf angle mounting bracket 50 has a structural section that has a back and a web, or webs. The web or webs may be referred to as a leg or legs, e.g., as in the back and legs of a channel section. The back has a rearwardly facing surface. The leg stands forwardly away from the back. The back has a mounting fitting by which to secure the mounting bracket to supporting structure. The web or leg has a forward margin distant from the back. The forward margin has a first portion located a datum distance away from the back. The forward margin includes a second portion defining a shelf angle seat. The shelf angle seat is located forwardly more distant from the back than the datum distance. The mounting bracket has a mortar net seat forwardly of the first portion. The shelf angle seat has a portion lying in a vertical plane, against which a rearwardly-facing surface of an upright leg of a shelf angle abuts in use. That portion of the shelf angle seat lies in a vertical plane that is forward of the first portion of the forward margin of the leg of the mounting bracket. The shelf angle seat has a vertically extending slot located forwardly of the first portion of the forward margin of the leg. The leg has a finger that extends forward of the first portion of the margin. The finger defines a retainer that, in use, locates forwardly of an upright leg of the shelf angle. The finger has a forward margin most distant from the back, and the mounting bracket defines a mortar net seat in a space forwardly of the first portion of the forward margin, between the first portion of the first margin and the forward margin of the finger. The leg of the mounting bracket includes a retainer that extends forwardly of the first portion of the forward margin. The forward margin has a second portion that is tapered from the first portion to the retainer. The mounting bracket is more than twice as tall as the shelf angle seat. The first portion of the forward margin of the leg has a greater vertical extent than does the shelf angle seat. The support structure is a floor slab, the mounting bracket extends at least one of (a) upwardly proud of the floor slab; and (b) downwardly proud of the floor slab. The shelf angle seat is located one of (a) upwardly of the floor slab; and (b) downwardly of the floor slab. The shelf angle is mounted to the bracket and has masonry veneer installed on the shelf angle. A mortar net is trapped between the masonry veneer and the first portion of the forward margin of the leg. The mounting bracket has the form of a channel section in has two the legs extending away from the back in mutual opposition. The mounting bracket has both upper and lower shelf angle mounting seats. Those seats are located forwardly of the first portion of the margin of the first leg.

Although the foregoing assembly 20 is described in the context of the desirability of not having an invasive mounting at the second load interface fitting, there are circumstances in which a non-invasive fitting is not be required, and an invasive fitting may be used, while still staying within the space envelope of a lower stud wall. That space envelope may be defined by the nominal 2×6 stud wall thickness depth discussed above. In that case, in the embodiment of FIGS. 4*a*, 4*b*, 5*a* and 5*b*, an assembly 220 is substantially the same as assembly 20, but differs from it to the extent that mounting fitting 90 is replaced by mounting fitting 200 which employs a threaded fastener 54 mounted in a blind bore 222 in the forward face of slab 36, and another threaded fastener 54 mounted in blind bore 224 formed vertically upwardly into the underside of slab 36. This second threaded fastener 54 of mounting fitting 200 secures to upper flange 66, as before, and in this instance flange 66 is drawn into mating engagement with the underside of slab 36. In this instance, threaded fastener 54 can have the form of a concrete anchor 226 that has a plastically deformable jacket that expands inside the bore when the threaded fastener is tightened, thus imposing radial compression in the concrete around the bore, be it 222 or 224. The underside fitting, while having the form of an intrusive embedment, nonetheless permits a moment reaction coupling distant from the connection at fitting 88 on the front face of slab 36, and thus yields a moment arm between the two engagement interfaces. That reinforcement occurs, once again, in the space envelope beneath slab 36 and rearwardly of the vertical planar end face of slab 36.

Various embodiments of the invention have been described in detail. Since changes in and or additions to the above-described best mode may be made without departing from the nature, spirit or scope of the invention, the invention is not to be limited to those details but only by the appended claims.

I claim:

1. A combination of a masonry veneer mounting bracket of a masonry veneer support assembly for mounting masonry veneer to supporting wall structure, at least a first mechanical fastener, and a shim for use in co-operation with the masonry veneer support assembly, insert said mounting bracket being a shelf angle mounting bracket, the support assembly having a shelf angle, said shelf angle mounting bracket, and a brace, on installation the brace being mounted between a portion of the mounting bracket and the wall structure; the shim having an accommodation formed therein to permit passage of said first mechanical fastener therethrough; on installation said shim being one of (a) a shim that mounts between the masonry veneer mounting bracket and the wall structure and having said first mechanical fastener passing therethrough, said shim defining a thermal resistor between said masonry veneer mounting bracket and the supporting wall structure; and (b) a shim that mounts between the masonry veneer mounting bracket and the brace with said first mechanical fastener passing therethrough, said shim defining a thermal resistor between said masonry veneer mounting bracket and said brace.

2. The combination of claim 1 wherein said shim is made of a polymer.

3. The combination of claim 1 wherein said shim is made of steel and has a polymeric coating.

4. The combination of claim 1 wherein said shim has a rectangular periphery and has an open-ended slot formed therein, said slot having an open end at said rectangular periphery, and said slot having a centerline that is angle diagonally relative to said rectangular periphery.

5. The combination of claim 4 wherein said first mechanical fastener is a concrete anchor that is mounted in the supporting wall structure and that extends outwardly therefrom, and on installation said open-ended slot permits said concrete anchor to be introduced into said open end of said open-ended slot and then seated in said open-ended slot distant from said rectangular periphery, said open end being located diagonally downwardly of the concrete anchor; and as tightened, the concrete anchor passing through said slot of said shim, and said shim being sandwiched between the masonry veneer support assembly and the wall structure.

6. The combination of claim 1 wherein said shim mounts between said masonry veneer mounting bracket and the supporting wall structure; said shim has a rectangular shape;

said shim has a width corresponding to a back of said shelf angle mounting bracket, and said shim has a diagonal slot formed therein.

7. The combination of claim 6 wherein, as installed, said first mechanical fastener is a concrete anchor and said concrete anchor passes through said slot.

8. The combination of claim 1 wherein said shim mounts between said masonry veneer mounting bracket and the brace; said shim has a rectangular shape; said shim has a width corresponding to a back of the shelf angle mounting bracket, and said shim has at least a first hole and a second hole formed therethrough to admit mounting hardware by which said masonry veneer mounting bracket is secured to the brace.

9. The combination of claim 1 wherein said shim is a first shim according to claim 1; said first shim mounts between said masonry veneer mounting bracket and the supporting wall structure; said first shim has a rectangular shape; said first shim has a width corresponding to a back of said shelf angle mounting bracket, and said first shim has a diagonal slot formed therein; and a second said shim that mounts between said masonry veneer mounting bracket and the brace; said second shim has a rectangular shape; said second shim has a width corresponding to the back of the shelf angle mounting bracket, and said second shim has at least a first hole and a second hole formed therethrough to admit mounting hardware by which said masonry veneer mounting bracket is secured to the brace, said second shim defining a second thermal resistor between said masonry veneer mounting bracket and the brace.

10. The combination of claim 9 wherein each of the first and second shims is one of (a) a polymer insulator; and (b) steel coated in a thermally resistive polymeric coating.

11. The combination of claim 1 and further including the brace.

12. The combination of claim 1 wherein said masonry veneer mounting bracket has a back, said shim is located between said back of said masonry veneer support bracket and the supporting wall structure; said shim has a rectangular shape corresponding in size and shape to said back of said masonry veneer support bracket; and said shim has an open-ended diagonally extending slot formed therein.

* * * * *